US011242165B2

(12) United States Patent
Basharanov et al.

(10) Patent No.: US 11,242,165 B2
(45) Date of Patent: Feb. 8, 2022

(54) WRAPPING MACHINE WITH IMPROVED CUT, CLAMP, AND SEAM SYSTEM

(71) Applicant: Haloila Bulgaria EOOD, Kardjali (BG)

(72) Inventors: Pavel Basharanov, Kardjali (BG); Ivaylo Ivanov, Kardjali (BG); Dinko Gospodinov, Dimitrovgrad (BG)

(73) Assignee: Haloila Bulgaria EOOD, Kardjali (BG)

( * ) Notice: Subject to any disclaimer, the term of this patent is extended or adjusted under 35 U.S.C. 154(b) by 280 days.

(21) Appl. No.: 16/507,721

(22) Filed: Jul. 10, 2019

(65) Prior Publication Data

US 2020/0039669 A1 Feb. 6, 2020

Related U.S. Application Data

(60) Provisional application No. 62/713,256, filed on Aug. 1, 2018.

(51) Int. Cl.

| | |
|---|---|
| ***B65B 11/04*** | (2006.01) |
| ***B65B 41/12*** | (2006.01) |
| ***B65B 57/04*** | (2006.01) |
| ***B65B 61/06*** | (2006.01) |

(52) U.S. Cl.

CPC ..... *B65B 11/045* (2013.01); *B65B 41/12* (2013.01); *B65B 57/04* (2013.01); *B65B 61/06* (2013.01)

(58) Field of Classification Search

CPC ..... B65B 11/045; B65B 11/04; B65B 41/12; B65B 57/04; B65B 61/10; B65B 61/06

USPC .... 53/461, 463, 441–442, 211, 375.9, 375.8, 53/389.2, 389.3, 587

See application file for complete search history.

(56) References Cited

U.S. PATENT DOCUMENTS

| | | | | |
|---|---|---|---|---|
| 4,204,377 | A * | 5/1980 | Lancaster | B65B 11/006 53/399 |
| 4,235,062 | A * | 11/1980 | Lancaster, III | B65B 11/006 53/399 |
| 4,299,076 | A * | 11/1981 | Humphrey | B65B 11/045 198/412 |
| 4,429,514 | A * | 2/1984 | Lancaster | B65B 11/04 53/210 |
| 4,432,185 | A * | 2/1984 | Geisinger | B65B 11/045 53/138.2 |
| 4,587,796 | A | 5/1986 | Haloila | |

(Continued)

FOREIGN PATENT DOCUMENTS

| | | |
|---|---|---|
| CA | 1215910 A | 12/1986 |
| EP | 1132299 A1 | 12/2001 |
| EP | 2205491 B1 | 4/2015 |

OTHER PUBLICATIONS

"European Extended Search Report", From corresponding Application No. 19189011.0-1016 (9 pages), dated Dec. 13, 2019.

*Primary Examiner* — Valentin Neacsu

(74) *Attorney, Agent, or Firm* — Neal, Gerber & Eisenberg LLP

(57) ABSTRACT

Various embodiments of the present disclosure provide a wrapping machine that includes an improved cut, clamp, and seam system configured to, after film drawn from a film roll has been wrapped around an object, cut the film from the film roll, hold the now-leading end of the film of the film roll, and attach the now-trailing end of the film wrapped around the object to part of the film wrapped around the object.

20 Claims, 37 Drawing Sheets

(56) References Cited

U.S. PATENT DOCUMENTS 4,590,737 A 5/1986 Rosenthal et al.
4,598,534 A 7/1986 Rosenthal et al.
4,619,102 A 10/1986 Geisinger
4,807,427 A 2/1989 Casteel et al.
4,955,181 A 9/1990 Casteel
4,991,381 A 2/1991 Simons
4,993,209 A 2/1991 Haloila
5,040,358 A 8/1991 Thimon
5,088,270 A * 2/1992 Diehl ..... B65B 11/025 53/399
5,195,301 A 3/1993 Martin-Cocher et al.
5,400,575 A 3/1995 Scherer
5,404,691 A 4/1995 Scherer
5,445,053 A 8/1995 Kallner
5,447,009 A * 9/1995 Oleksy ..... B65B 11/045 53/375.9
5,452,566 A 9/1995 Benhamou et al.
5,572,855 A 11/1996 Reigrut et al.
5,575,138 A 11/1996 Reigrut et al.
5,787,691 A 8/1998 Turfan et al.
5,797,240 A 8/1998 Martin-Cocher et al.
5,874,617 A 3/1999 Scherer
6,393,808 B1 5/2002 Kallner et al.
6,539,690 B2 4/2003 Alvarez
6,694,712 B2 2/2004 Suolahti
6,848,240 B2 2/2005 Frey
7,178,317 B1 * 2/2007 Koskela ..... B65B 11/045 242/597.8
8,641,027 B2 * 2/2014 Koskela ..... B65B 11/045 269/57
9,981,762 B2 * 5/2018 Chalmers ..... B65D 19/00
10,138,012 B2 11/2018 Koskela et al.
2001/0015050 A1 8/2001 Lancaster et al.
2002/0162436 A1 * 11/2002 Marois ..... B65B 11/045 83/13
2008/0066431 A1 * 3/2008 Cousins ..... B65B 11/045 53/465
2009/0293425 A1 * 12/2009 Carter ..... B65B 11/045 53/167
2015/0151861 A1 * 6/2015 Chalmers ..... B65B 11/045 53/556
2017/0088301 A1 * 3/2017 Riemenschneider, III ..... B65B 59/003
2017/0361955 A1 * 12/2017 Luo ..... B65B 65/02

* cited by examiner

WRAPPING MACHINE WITH IMPROVED CUT, CLAMP, AND SEAM SYSTEM

PRIORITY

This application claims priority to and the benefit of U.S. Provisional Patent Application No. 62/713,256, filed Aug. 1, 2018, the entire contents of which is incorporated herein by reference.

FIELD

The present disclosure relates to wrapping machines, and more particularly to a wrapping machine that includes an improved cut, clamp, and seam system.

BACKGROUND

Several types of known wrapping machines use stretch wrap to prepare palletized loads of goods or other objects (palletized or not) for shipment. These wrapping machines include a film carriage on which a roll of stretch film is mounted. These wrapping machines cause relative rotation between the film carriage and the load and relative vertical movement between the film carriage and the load to wrap the load with the stretch film in a spiral pattern. For instance, a turntable wrapping machine rotates a turntable on which the load is positioned while vertically moving the film carriage to wrap the load with the stretch film in a spiral pattern. A ring wrapping machine rotates the film carriage on a circular ring around the load while vertically moving the film carriage to wrap the load with the stretch film in a spiral pattern. A rotating and wrapping machine rotates the film carriage on a cantilevered arm around the load while vertically moving the film carriage to wrap the load with the stretch film in a spiral pattern.

Some known wrapping machines include a cut, clamp, and seam system that is configured to, at the end of the wrapping process: (1) cut the film from the film roll to form a trailing end of the film that is wrapped around the load and to form a leading end of the film still on the roll; (2) attach the trailing end of the film to part of the film already wrapped around the load; and (3) hold the leading end of the film still on the roll in preparation for the next wrapping process.

SUMMARY

Various embodiments of the present disclosure provide a wrapping machine that includes an improved cut, clamp, and seam system configured to, after film drawn from a film roll has been wrapped around an object, cut the film from the film roll, hold the now-leading end of the film of the film roll, and attach the now-trailing end of the film wrapped around the object to part of the film wrapped around the object.

In various embodiments, a wrapping machine of the present disclosure comprises a base; a turntable rotatable relative to the base; and a cut, clamp, and seam system. The cut, clamp, and seam system comprises a cut-and-seam assembly movable among a film-release position, an intermediate position, and a seaming position; an actuating assembly supported by the base and to which the cut-and-seam assembly is mounted, the actuating assembly movable among a film-release configuration, an intermediate, configuration, and a seaming configuration; and a film-release assembly supported by the base, the film-release assembly movable between a rest configuration and a film-release configuration. When the actuating assembly is in the film-release configuration, the cut-and-seam assembly is in the film-release position and the film-release assembly is in the film-release configuration. When the actuating assembly is in the intermediate configuration, the cut-and-seam assembly is in the intermediate position and the film-release assembly is in the rest configuration. When the actuating assembly is in the seaming configuration, the cut-and-seam assembly is in the seaming position and the film-release assembly is in the rest configuration.

In various embodiments, a method of operating a wrapping machine comprises: with a film-hold-and-release assembly holding a leading end of a roll of film, rotating a turntable on which the film-hold-and-release assembly is mounted relative to an actuating assembly; moving the actuating assembly to a film-release configuration, thereby causing a film-release assembly to move to a film-release configuration; and continue rotating the turntable such that the film-hold-and-release assembly contacts the film-release assembly, thereby causing the film-hold-and-release assembly to release the leading end of the film.

DETAILED DESCRIPTION

Figure 1:
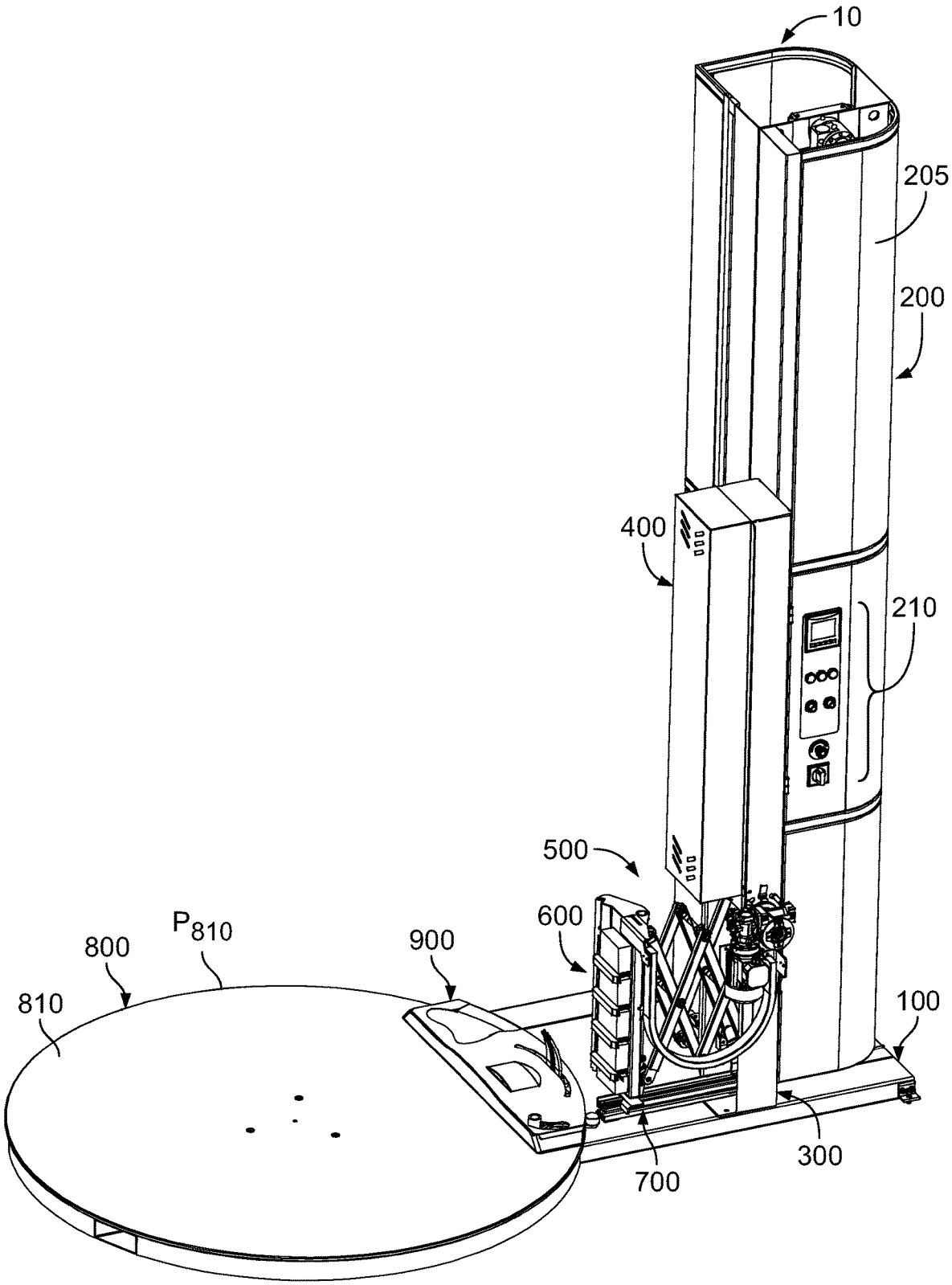
FIG. 1 is a perspective view of one example embodiment of a wrapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a wrapping machine that includes an improved cut, clamp, and seam system configured to, after film drawn from a film roll has been wrapped around an object, cut the film from the film roll, hold the now-leading end of the film of the film roll, and attach the now-trailing end of the film wrapped around the object to part of the film wrapped around the object.

Figure 2:
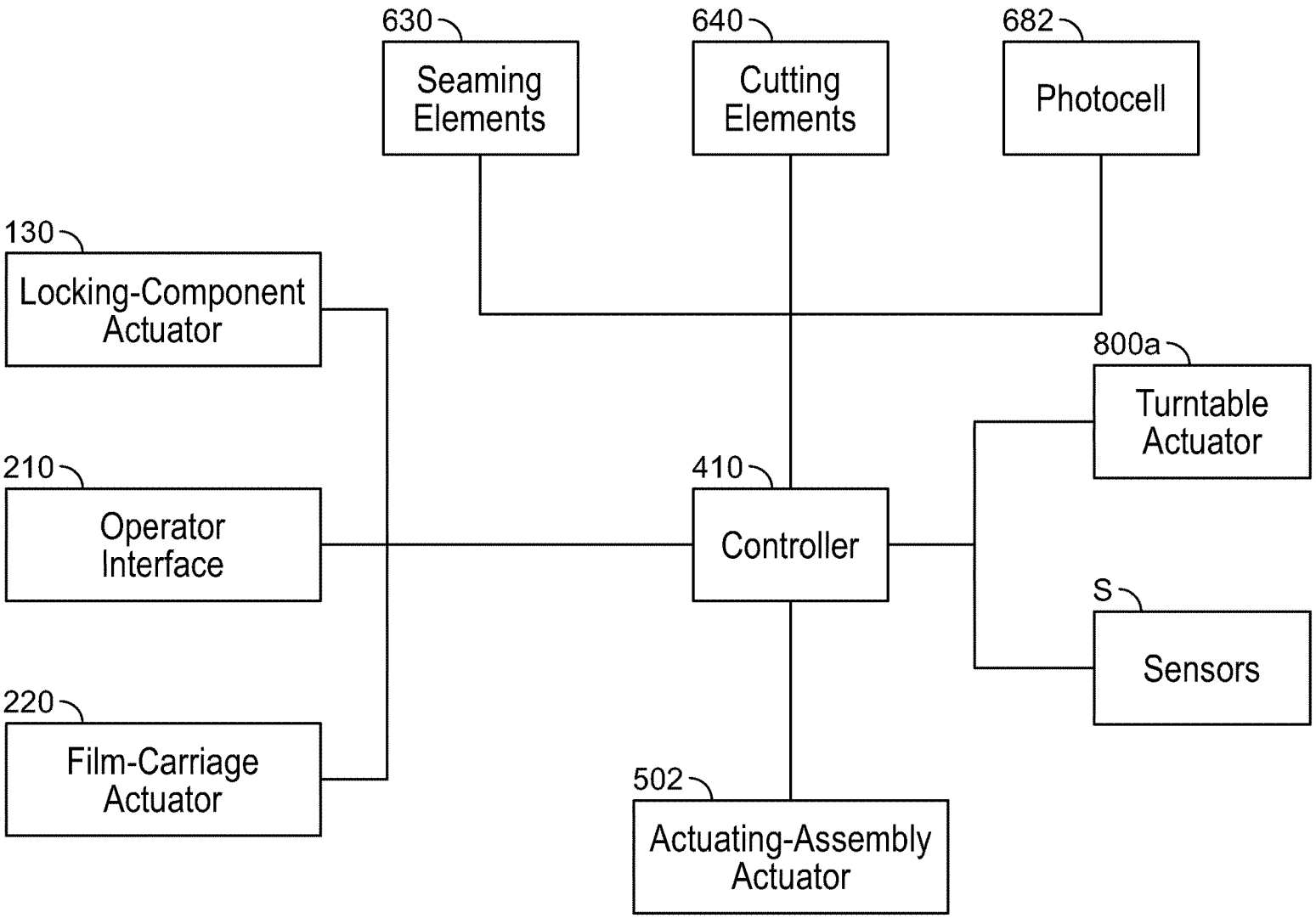
FIG. 2 is a block diagram showing certain components of the wrapping machine of FIG. 1.

FIG. 1 shows one embodiment of the wrapping machine 10 of the present disclosure. The wrapping machine 10 is a turntable wrapping machine, though the cut, clamp, and seam system of the present disclosure may be employed with any type of wrapping machine (such as a ring or rotary arm wrapping machine). As shown in FIG. 2, the wrapping machine 10 also includes several actuators and other components controlled via a controller responsive to feedback from one or more sensors S, as described below.

The wrapping machine 10 includes a base 100, a tower 200, a mounting assembly 300, a control assembly 400, an actuating assembly 500, a cut-and-seam assembly 600, a film-release assembly 700, a turntable assembly 800, and a film-hold-and-release assembly 900. In this example embodiment, the cut, clamp, and seam system includes the actuating assembly 500, the cut-and-seam assembly 600, the film-release assembly 700, and the film-hold-and-release assembly 900 (though it may include any suitable combination of components).

The base 100 includes a suitable framework configured to support some (or all) of the remaining components of the wrapping machine 10. The base 100 includes a turntable-locking assembly that includes a locking component 120 (FIGS. 12A-12H), a linkage (not shown), and a locking-component actuator 130 (FIG. 2). The locking component 120 is movable relative to the turntable assembly 800 and the film-hold-and-release assembly 900 (as described below) between a rest position and a locking position. The linkage operably connects the locking-component actuator 130 with the locking component 120 such that the locking-component actuator 130 is configured to move the locking component 120 between the rest and locking positions. As explained below, the locking component 120 is configured to, when inthe locking position, prevent a turntable 810 of the turntable assembly 800 from rotating relative to the base 100 and, when in the rest position, enable the turntable 810 to rotate relative to the base 100.

The tower 200 is supported by the base 100. The tower 200 includes a housing 205 that supports an operator interface 210, which may include one or more input and/or output devices, such as one or more buttons, a display device, and/or a touch screen. The housing 205 encloses a film carriage (not shown) configured to support a roll of film (not shown), as is generally known in the art. The housing 205 also encloses a suitable film-carriage actuator 220 (FIG. 2) operably connected to the film carriage and configured to move the film carriage (and the roll thereon) vertically between lower and upper positions. The housing 205 defines a suitably sized and positioned opening through which film can extend from the roll to the load to-be-wrapped. A controller 410 of the control assembly 400 (explained below) is operably connected to the film-carriage actuator 205 to control operation of the film-carriage actuator 205. The housing 205 also encloses a turntable actuator 800*a* (FIG. 2) operably coupled to the turntable assembly 800 and configured to rotate the turntable 810 of the turntable assembly 800, as described below. The controller 410 is operably connected to the turntable actuator 800*a* to control operation of the turntable actuator 800*a*.

Figure 3:
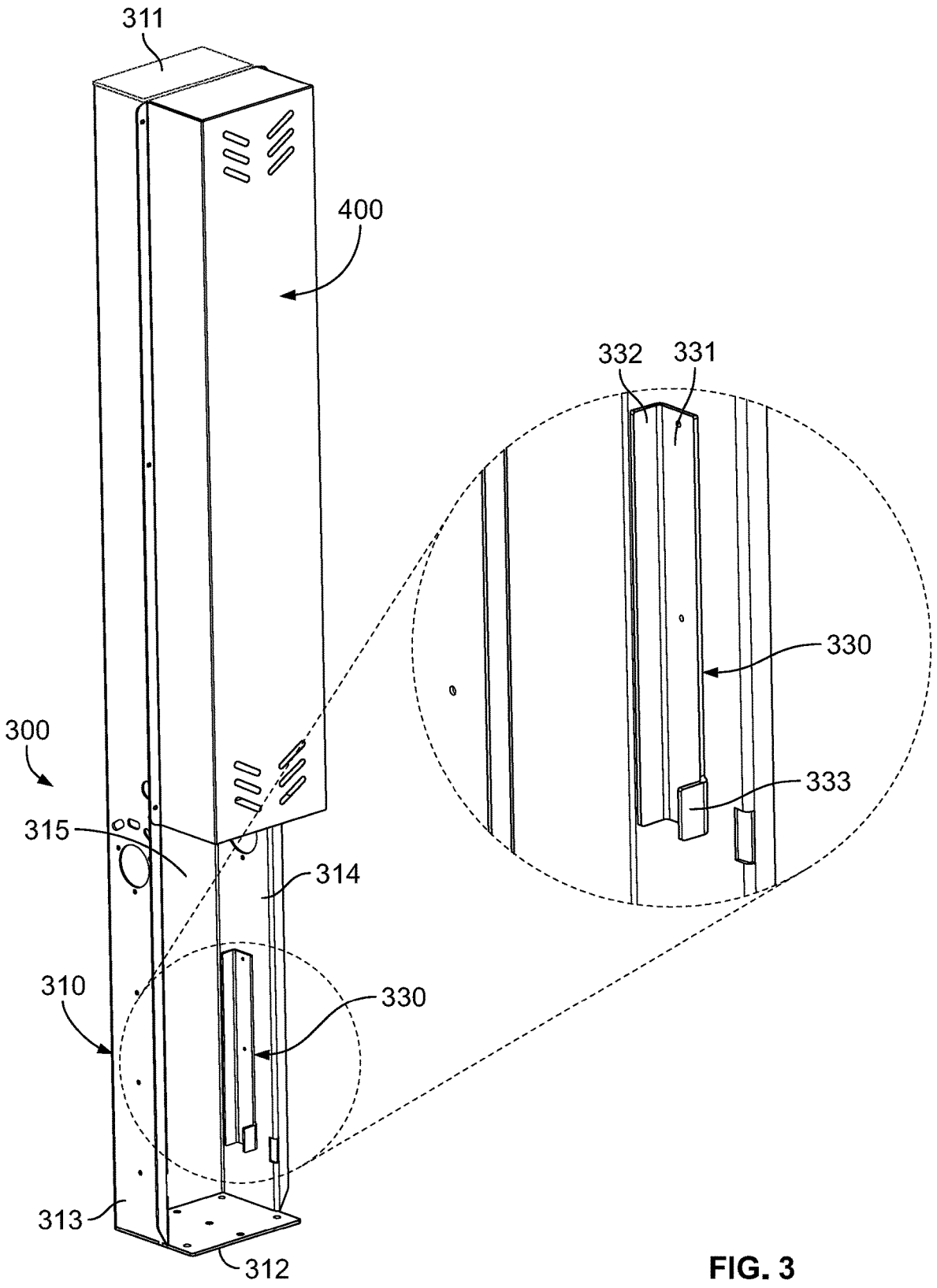
FIG. 3 is a perspective view of the mounting assembly and the control assembly of the wrapping machine of FIG. 1.
Figure 4A:
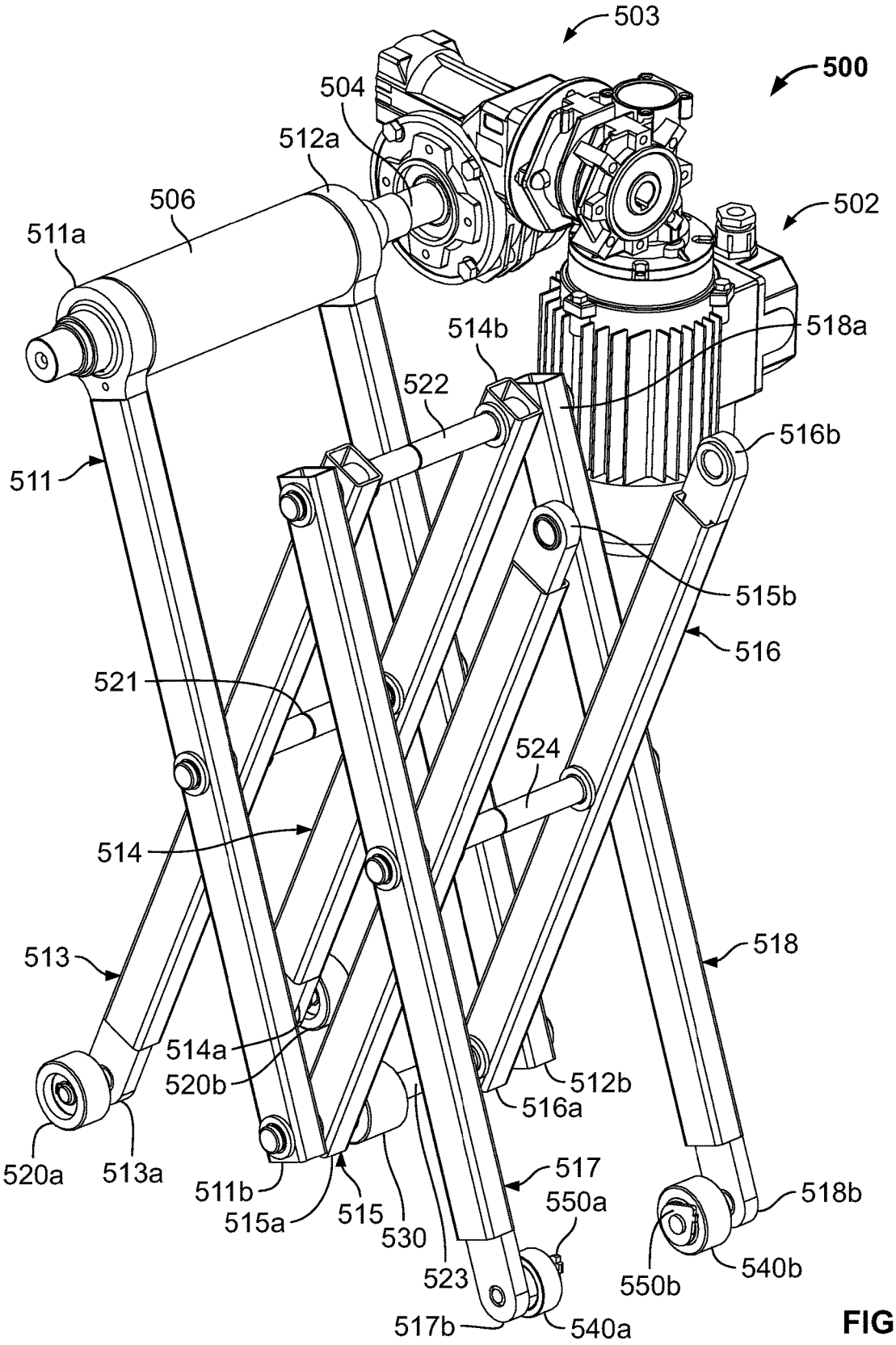
FIGS. 4A-4C are perspective views of the actuating assembly of the wrapping machine of FIG. 1.
Figure 4B:
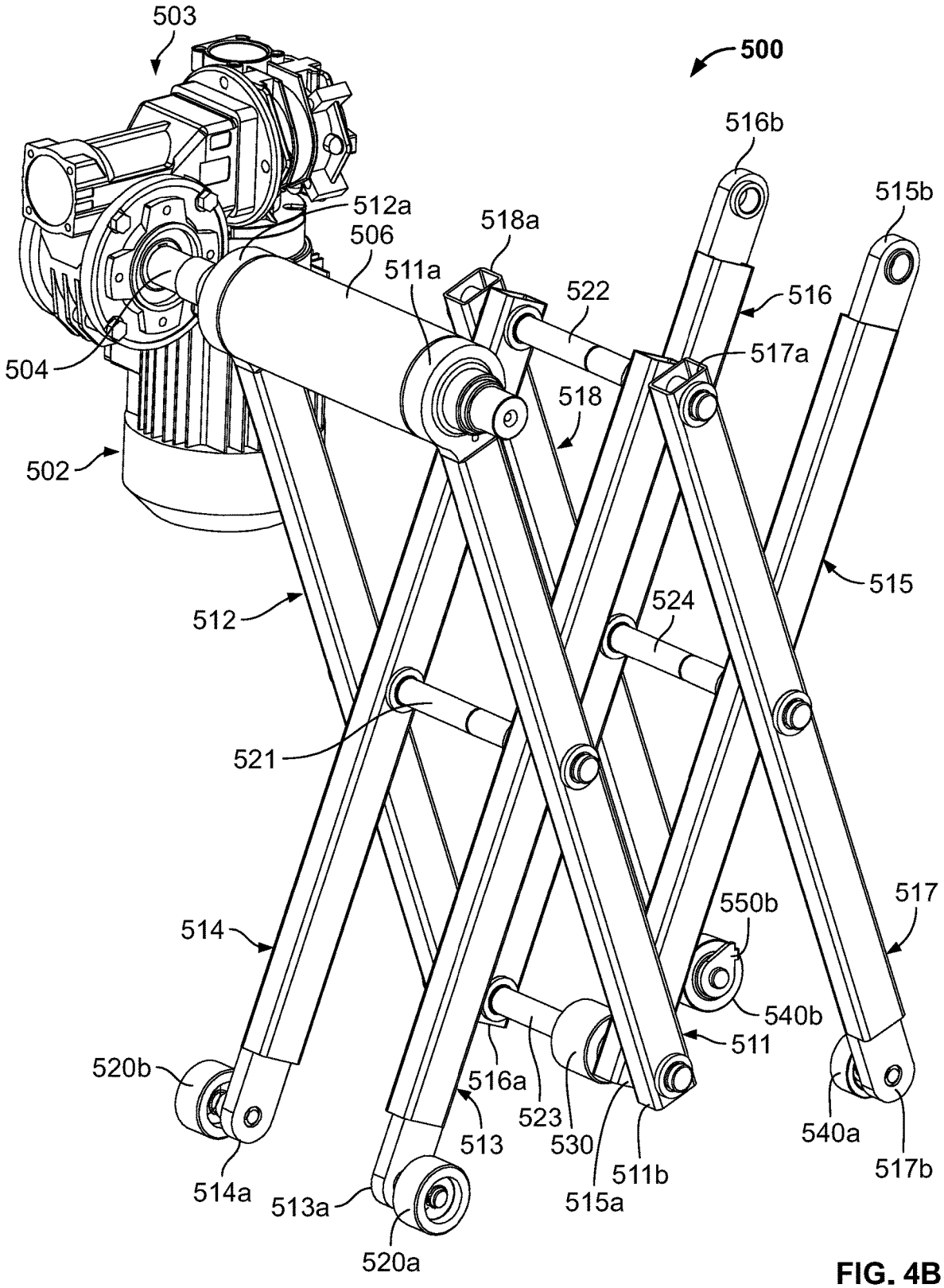
Figure 4C:
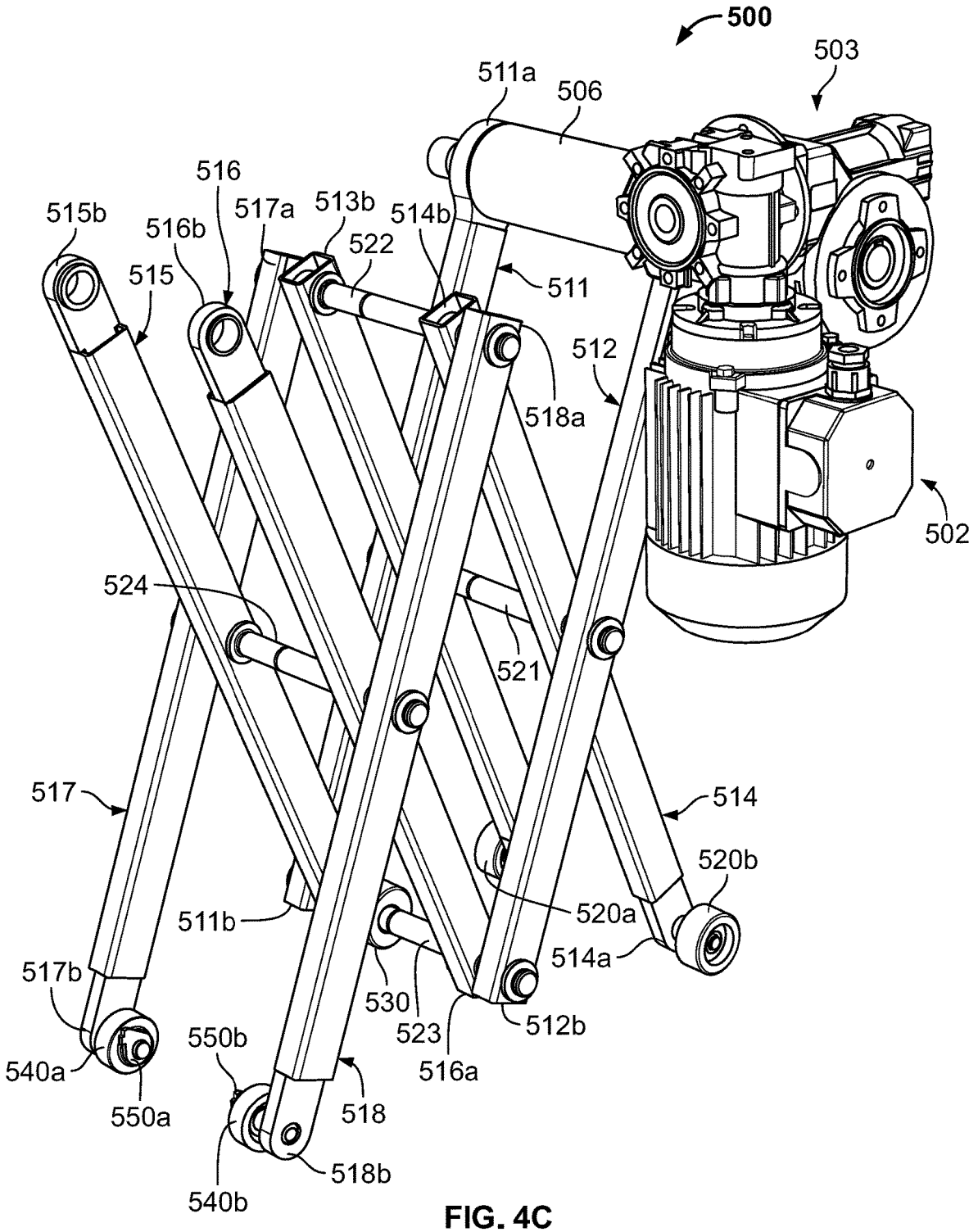
Figure 4D:
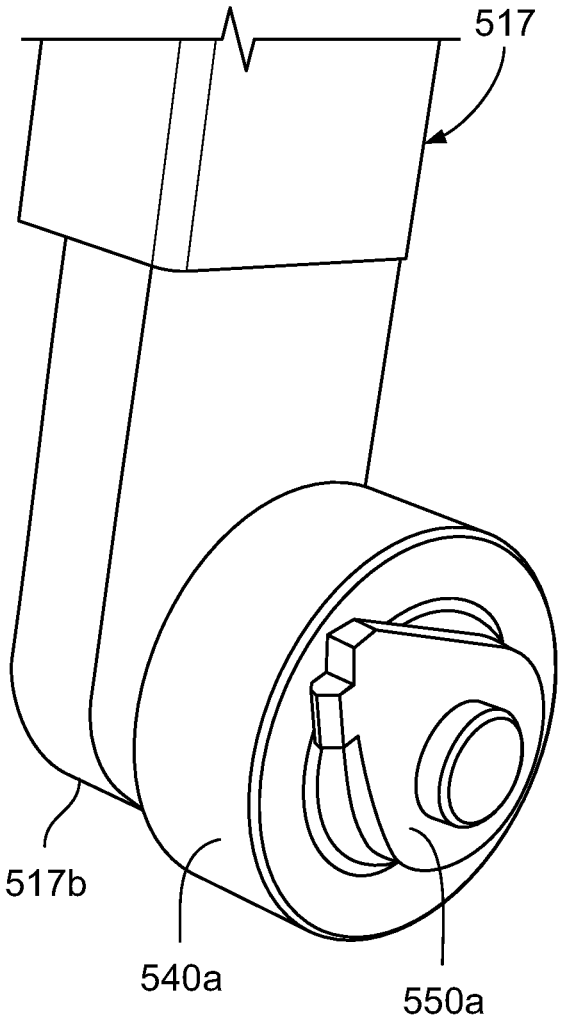
FIG. 4D is a fragmentary perspective view of part of the actuating assembly of FIGS. 4A-4C.

The mounting assembly 300 serves as a mount for the control assembly 400, the actuating assembly 500, the cut-and-seam assembly 600, and part of the film-release assembly 700. As best shown in FIG. 3, the mounting assembly 300 includes a mounting bracket 310, a first roller-receiving bracket 320, and a second roller-receiving bracket 330. The first roller-receiving bracket 320 is not shown, but is numbered for ease of reference and (in this embodiment) is identical to the second roller-receiving bracket 330.

The mounting bracket 310 includes an upper wall 311, an opposing lower wall 312, a first side wall 313, an opposing second side wall 314, and a rear wall 315 that connects and extends between the upper and lower walls 311 and 312 and the first and second side walls 313 and 314. The first roller-receiving bracket 320 includes a base 321, a rear wall 322 transverse to and extending from one side of the base 321, and a front wall 323 transverse to and extending from the opposite side of the base 321. Similarly, the second roller receiving bracket 330 includes a base 331, a rear wall 332 transverse to and extending from one side of the base 331, and a from wall 333 transverse to and extending from the opposite side of the base 331.

The first roller-receiving bracket 320 is mounted to the first side wall 313 of the mounting bracket 310 such that the rear wall 322 and the front wall 323 are generally parallel to the rear wall 315 of the mounting bracket 310 and the rear wall 322 is closer than the front wall 323 to the rear wall 315. Similarly, the second roller-receiving bracket 330 is mounted to the second side wall 314 of the mounting bracket 310 such that the rear wall 332 and the front wall 333 are generally parallel to the rear wall 315 of the mounting bracket 310 and the rear wall 332 is closer than the front wall 333 to the rear wall 315.

As best shown in FIG. 3, the control assembly 400 is mounted to an upper portion of the mounting bracket 310 of the mounting assembly 300. The control assembly 400 includes the controller 410, which includes a processing device (or devices) communicatively connected to a memory device (or devices). The processing device may include any suitable processing device or devices such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping machine 10 (such as to carry out a wrapping process, as described below).

As explained throughout, the controller 410 is operably connected to various actuators and other components of the wrapping machine 10 to control those actuators and components. As also explained throughout, the controller 410 is communicatively connected to various sensors S and input devices of the wrapping machine 10 to receive signals from these sensors S and input devices and control the actuator(s) responsive to these signals. For instance, the controller 410 is communicatively connected to the one or more input devices of the operator interface 210 to receive signals that correspond to inputs made via the one or more input devices. The controller 410 is also communicatively connected to one or more output devices of the operator interface 210 to send signals to the one or more output devices to cause the one or more output devices to output (such as to display) information.

The actuating assembly 500 is configured to move among a film-release (first) configuration, an intermediate (second) configuration, and a seaming (third) configuration to move the cut-and-seam assembly 600 mounted thereto among a film-release (first) position, an intermediate (second) position, and a seaming (third) position, respectively. The actuating assembly 500 is also configured to move the film-release assembly 700 from a rest configuration to a film-release configuration (as explained below).

As best shown in FIGS. 4A-4D, the actuating assembly 500 includes: an actuating-assembly actuator 502; gearing 503; a drive shaft 504; a sleeve 506; first, second, third, fourth, fifth, sixth, seventh, and eighth links 511-518; first, second, third, and fourth link connecting shafts 521-524; first and second rollers 520*a* and 520*b*; a film-release-assembly engager 530; third and fourth rollers 340*a* and 340*b*; and first and second connector engagers 550*a* and 530*b*.

The actuating-assembly actuator 502 includes an electric motor, though it may include any suitable type(s) of actuator(s) in other embodiments. The gearing 503 includes two in-line worm gearboxes operably connected to one another, though the gearing may include any suitable type(s) of gearing in other embodiments. The drive shaft 504 includes a solid or tubular member having a circular (or any other suitably shaped) cross-section. The sleeve 506 includes a tubular member having a circular (or any other suitably shaped) cross-section. In certain embodiments, the actuating assembly does not include the sleeve.

In this example embodiment, the actuating-assembly actuator 502 is operably connected to the drive shaft 504 via the gearing 503 and configured to rotate the drive shaft 504 (via manipulation of the gearing 503). That is, the gearing 503 is configured to convert the output of the actuating-assembly actuator 502 (such as the rotation of an output shaft of the actuating-assembly actuator 502) into rotation of the drive shaft 504, one end of which is received by the gearing 503. The sleeve 506 surrounds part (or in other embodiments, all) of the drive shaft 504 between the ends of the drive shaft 504. The sleeve 506 is fixedly attached to the drive shaft 504 (such as via a keyed or a splined connection) to rotate with the drive shaft 504.

The links 511-518 include tubular or solid members having a rectangular (or any other suitably shaped) cross-section. The link-connecting shafts 521-524 include tubular or solid members having a circular (or any other suitably shaped) cross-section. The link-connecting shafts 521-524 interconnect the links 511-518 as described below such that movement of the first and second links 511 and 512 (via rotation of the drive shaft 504 and the sleeve 506) causes the other links 513-518 and the link-connecting shafts 521-524 to move.

The first link 511 and the second link 512 are fixedly connected at their respective first ends 511*a* and 512*a* (such as via separate keyed connections) to the sleeve 506 at respective opposite ends of the sleeve 506 such that rotation of the sleeve 506 (caused by rotation of the drive shaft 504) causes the first and second links 511 and 512 to rotate with the sleeve 506. The first link 511 and the second link 512 are rotatably connected to the third link-connecting shaft 523 at their respective second ends 511*b* and 512*b* such that the first and second links 511 and 512 can rotate around the third link-connecting shaft 523. The first link 511 is rotatably connected to the first link-connecting shaft 521 between its first and second ends 511*a* and 511*b* such that the first link 511 can rotate around the first link-connecting shaft 521. Similarly, the second link 512 is rotatably connected to the first link-connecting shaft 521 between its first and second ends 512*a* and 512*b* such that the second link 512 can rotate around the first link-connecting shaft 521.

The third link 513 is rotatably connected to the first link-connecting shaft 521 between its first and second ends 513*a* and 513*b* such that the third link 513 can rotate around the first link-connecting shaft 521. Similarly, the fourth link 514 is rotatably connected to the first link-connecting shaft 521 between its first and second ends 514*a* and 514*b* such that the fourth link 514 can rotate around the first link-connecting shaft 521. The first roller 520*a* is rotatably connected to the first end 513*a* of the third link 513 (such as rotatably mounted on a shaft at the first end 513*a*) such that the first roller 520*a* can rotate relative to the third link 513. Similarly, the second roller 520*b* is rotatably connected to the first end 514*a* of the fourth link 514 (such as rotatably mounted on a shaft at the first end 514*a*) such that the second roller 520*b* can rotate relative to the fourth link 514. The third link 513 and the fourth link 514 are rotatably connected to the second link-connecting shaft 522 at their respective second ends 513*b* and 514*b* such that the third and fourth links 513 and 514 can rotate around the second link-connecting shaft 522.

The fifth link 515 and the sixth link 516 are rotatably connected to the third link-connecting shaft 323 at and their respective first ends 515*a* and 516*a* such that the fifth and sixth links 515 and 516 can rotate around the third link-connecting shaft 523. The fifth link 515 is rotatably connected to the fourth link-connecting shaft 524 between its first and second ends 515*a* and 515*b* such that the fifth link 515 can rotate around the fourth link-connecting shaft 524. The sixth link 516 is rotatably connected to the fourth link-connecting shaft 524 between its first and second ends 516*a* and 516*b* such that the sixth link 516 can rotate around the fourth link-connecting shaft 524. The cut-and-seam assembly 600 is mounted to the actuating assembly 500 in part via the second ends 515*b* and 516*b* of the fifth and sixth links 515 and 516, as explained below.

The seventh link 517 and the eighth link 518 are rotatably connected to the second link-connecting shaft 522 at and their respective first ends 517*a* and 518*a* such that the seventh and eighth links 517 and 518 can rotate around the second link-connecting shaft 522. The seventh link 517 is rotatably connected to the fourth link connecting shaft 521 between its first and second aids 517*a* and 517*b* such that the seventh link 517 can rotate around the fourth link-connecting shaft 524. Similarly, the eighth link 518 is rotatably connected to the fourth link-connecting shaft 524 between its first and second ends 518*a* and 518*b* such that the eighth link 518 can rotate around the fourth link-connecting shaft 524. The third roller 504*a* and the first connector engager 5541*a* are rotatably connected to the second end 517*b* of the seventh link 517 (such as rotatably mounted on a shaft at the second end 517*b*) such that the fourth roller 5441*a* and the second connector engager 550*b* can rotate relative to the seventh link 517. Similarly, the fourth roller 540*b* and the second connector engager 550*b* are rotatably connected to the second end 518*b* of the eighth link 518 (such as rotatably mounted on a shaft at the second end 518*b*) such that the fourth roller 540*b* and the second connector engager 550*b* can rotate relative to the eighth link 518. The cut-and-seam assembly 600 is mounted to the actuating assembly 500 in part via the first and second connector engagers 550*a* and 550*b*, as explained below.

The film-release-assembly engager 530 includes a tubular body fixedly connected (such as via a keyed, splined, or friction-fit connection) (or rotatably connected) to the third link-connecting shaft 523 between the fifth and sixth links 515 and 516. The film-release-assembly engager 530 is positioned to engage the lever 740 of the film-release assembly 700 (explained below) when the actuating assembly 500 is in the film-release configuration (explained below).

The controller 410 is operably connected to the actuating-assembly actuator 502 and configured to control operation of the actuating-assembly actuator 502. In operation, the controller 410 is configured to operate the actuating-assembly actuator 502 to move the actuating assembly 500—and particularly the links 511-518, the link-connecting shafts 521-524, and the other components connected thereto—among the film-release configuration, the intermediate configuration, and the seaming configuration by controlling the rotational positions of the first and second links 511 and 512. To do so, the controller 410 is configured to control the direction and extent of the rotation of the drive shaft 504 (which is operably connected to the first and second links 511 and 512 via the sleeve 506) via operation of the actuating-assembly actuator 502. The controller 410 may do so based on feedback from suitable sensors S, such as proximity sensors or an encoder of the actuator.

Figure 9A:
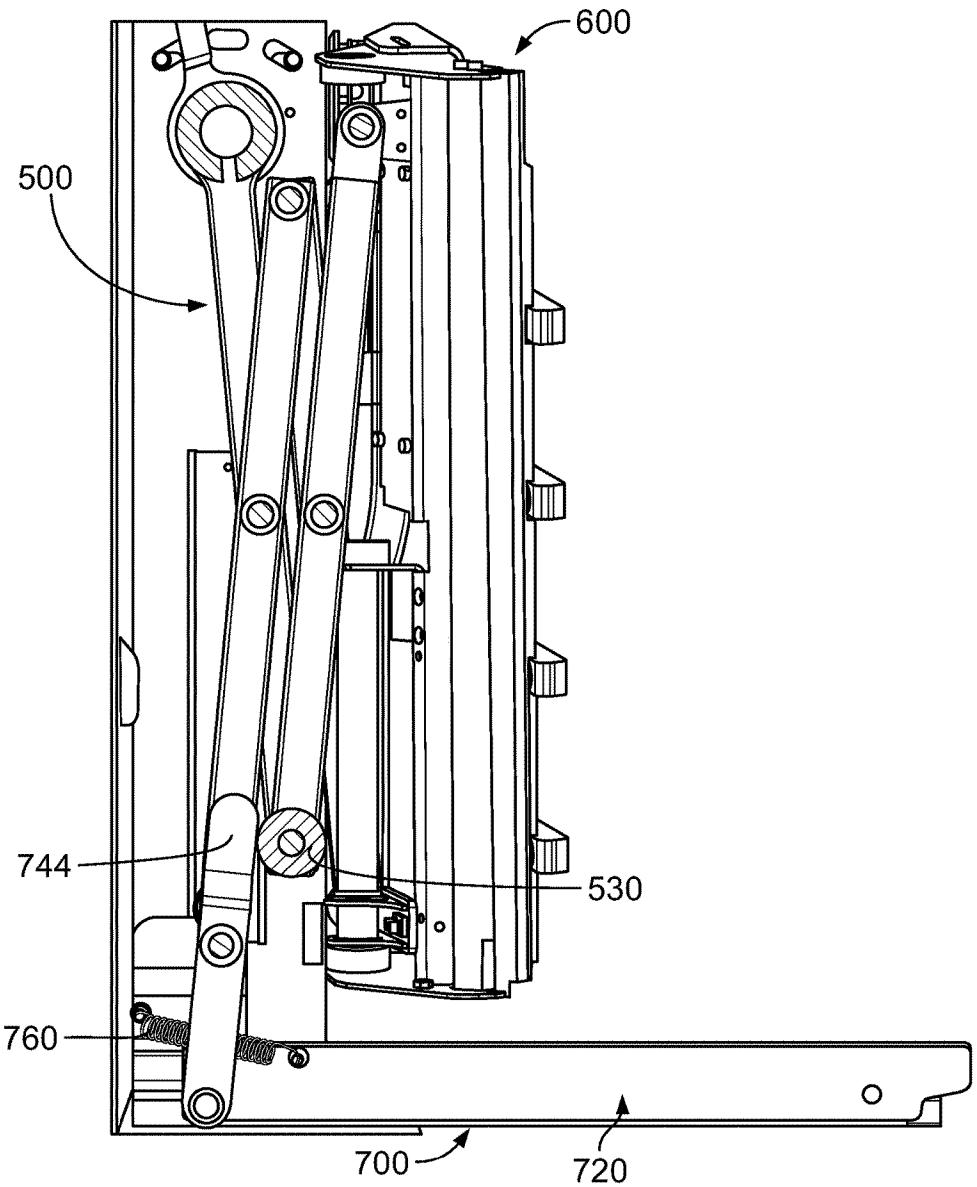
FIG. 9A is a fragmentary side elevational view of the mounting assembly of FIG. 3, the actuating assembly of FIGS. 4A-4C, the cut-and-scam assembly of FIGS. 5A and 5B, and the film-release assembly of FIGS. 8A and 8B with the actuating assembly in a film-release configuration, the cut-and-seam assembly in a film-release position, and the film-release assembly in the film-release configuration.
Figure 9B:
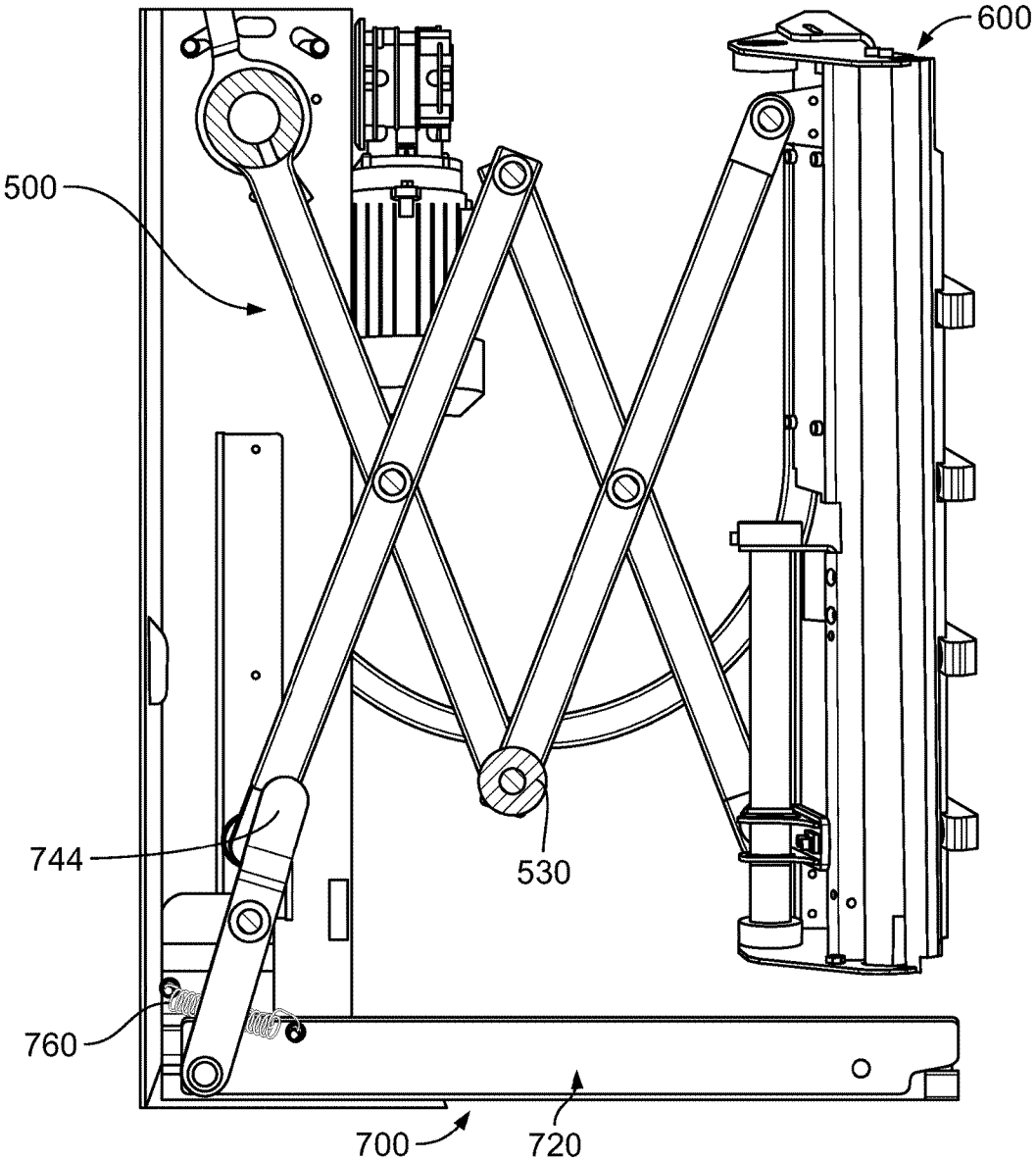
FIG. 9B is a fragmentary side-elevational view of the mounting assembly of FIG. 3, the actuating assembly of FIGS. 4A-4C, the cut-and-seam assembly of FIGS. 5A and 5B, and the film-release assembly of FIGS. 8A and 8B with the actuating assembly in an intermediate configuration, the cut-and-seam assembly in an intermediate position, and the film-release assembly in the rest configuration.
Figure 9C:
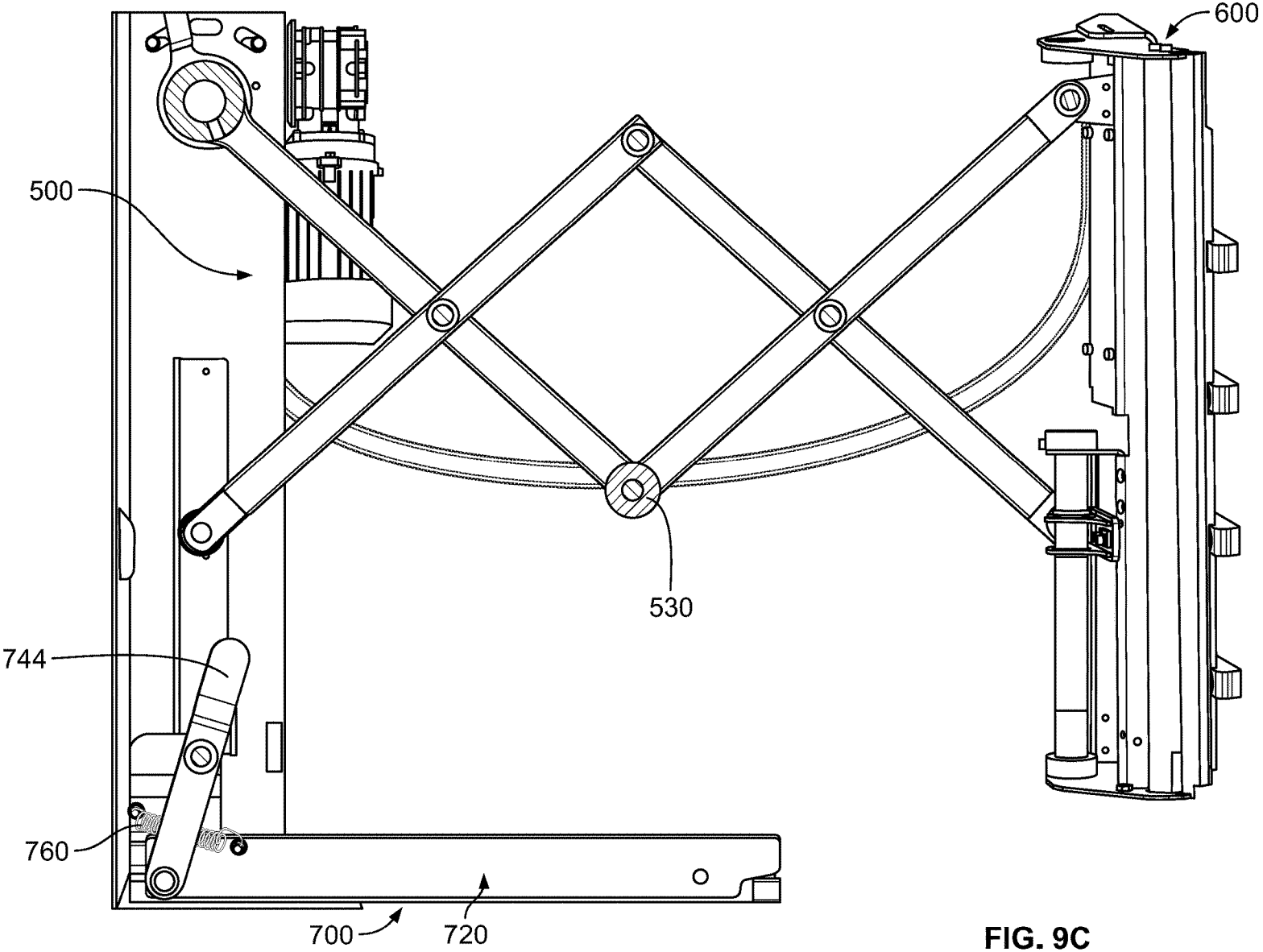
FIG. 9C is a fragmentary side elevational view of the mounting assembly of FIG. 3, the actuating assembly of FIGS. 4A-4C, the cut-and-seam assembly of FIGS. 5A and 5B, and the film-release assembly of FIGS. 8A and 8B with the actuating assembly in a seaming configuration, the cut-and-seam assembly in a seaming position, and the film-release assembly in the rest configuration.

In this example embodiment, the film-release configuration is a collapsed configuration in which the links 511-518 approach a vertical orientation and the film-release-assembly engager 550 engages the lever 740 of the film-release assembly 700, as shown in FIG. 9A and explained below. In this example embodiment, the seaming configuration is an extended configuration in which the links 511-518 approach a horizontal orientation, as shown in FIG. 9C and explained below. In this example embodiment, the intermediate configuration is in between the film-release and seaming configurations, as shown in FIG. 9B and explained below. In the intermediate configuration, the film-release-assembly engager 530 does not engage the lever 740 of the film-release assembly 700 (or engages the lever 740 in a manner that does not result in the film-release assembly 700 being in the film-release configuration).

The cut-and-seam assembly 600 is configured to cut the film from the roll to form a trailing end of the film that is wrapped around the load and to form a leading end of the film still on the roll. The cut-and-seam assembly 600 is also configured to attach the trailing end of the film to part of the film already wrapped around the load. The cut-and-seam assembly 600 is further configured to cause the film-hold-and-release assembly 900 to grasp and hold part of the leading end of the film still on the roll in preparation for the next wrapping process. To enable the cut-and-seam assembly 600 to carry out this functionality, the cut-and-seam assembly 600 is mounted to the actuating assembly 500 and movable (via reconfiguration of the actuating assembly 500) between the film-release (first) position, the intermediate (second) position, and the seaming (third) position.

As best shown in FIGS. 5A-5E, the cut-and-seam assembly 600 includes: a mounting bracket 602 having an outer surface 602*a* and an inner surface 602*b*; an upper bracket 604; an intermediate bracket 605; a lower bracket 606; a film-hold-and-release assembly engager 608; a first actuating-assembly-mounting bracket 610*a*; a second actuating-assembly-mounting bracket 610*b*; first, second, third, fourth, and fifth pads 620*a*-620*e*; first, second, third, and fourth seaming elements 630*a*-630*d*; a cutting element 640; a connector mounting shaft 650; an actuating assembly connector 660; a cover, plate 670; a photocell 682; and a reflector 684.

The mounting bracket 602 is oriented generally vertically, the upper bracket 604 is oriented transverse to the mounting bracket 602 and connected to the upper end of the mounting bracket 602, the lower bracket 606 is oriented transverse to the mounting bracket 602 and connected to the lower end of the mounting bracket 602, and the intermediate bracket 605 is oriented transverse to the mounting bracket 602 and connected to the mounting bracket 602 between the upper and lower brackets 604 and 606. The first and second actuating-assembly-mounting brackets 610*a* and 610*b* are oriented transverse to the mounting bracket 602 and Connected to the mounting bracket 602 near its upper end. The film-hold-and-release assembly engager 608, which includes a base 608*a* and a foot 608*b* transverse to the base 608*a*, is connected to the lower bracket 606 such that the foot 608*b* extends downward (away from the lower bracket 606).

The photocell 682 includes a transmitter configured to transmit a beam B (such as a light beam) and a receiver configured to detect the beam B (when reflected back to the receiver). The reflector 684 includes a suitable surface configured to reflect the beam the photocell 682 transmits, as indicated by the reflected beam R in FIG. 5D.

Figure 5A:
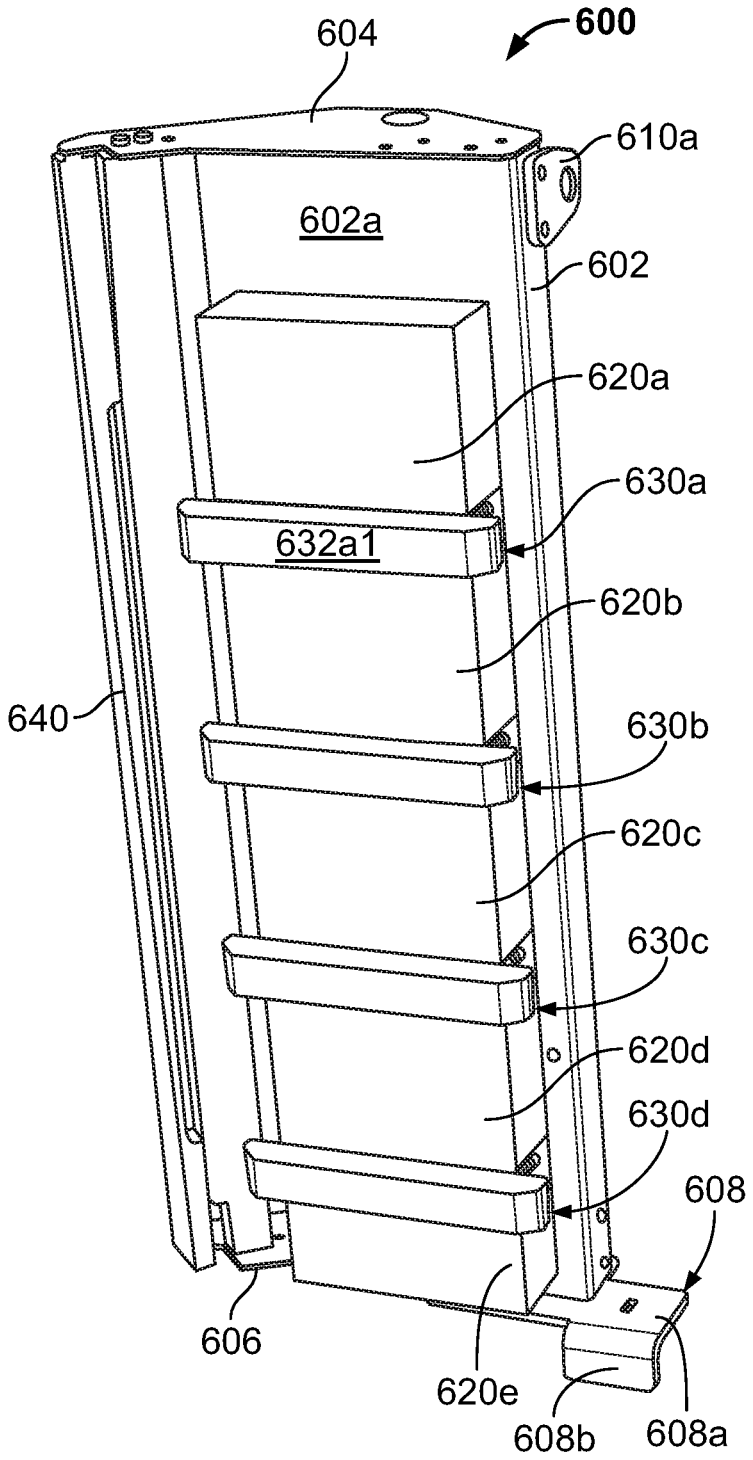
FIGS. 5A and 5B are perspective views of the cut-and-seam assembly of the wrapping machine of FIG. 1.
Figure 5B:
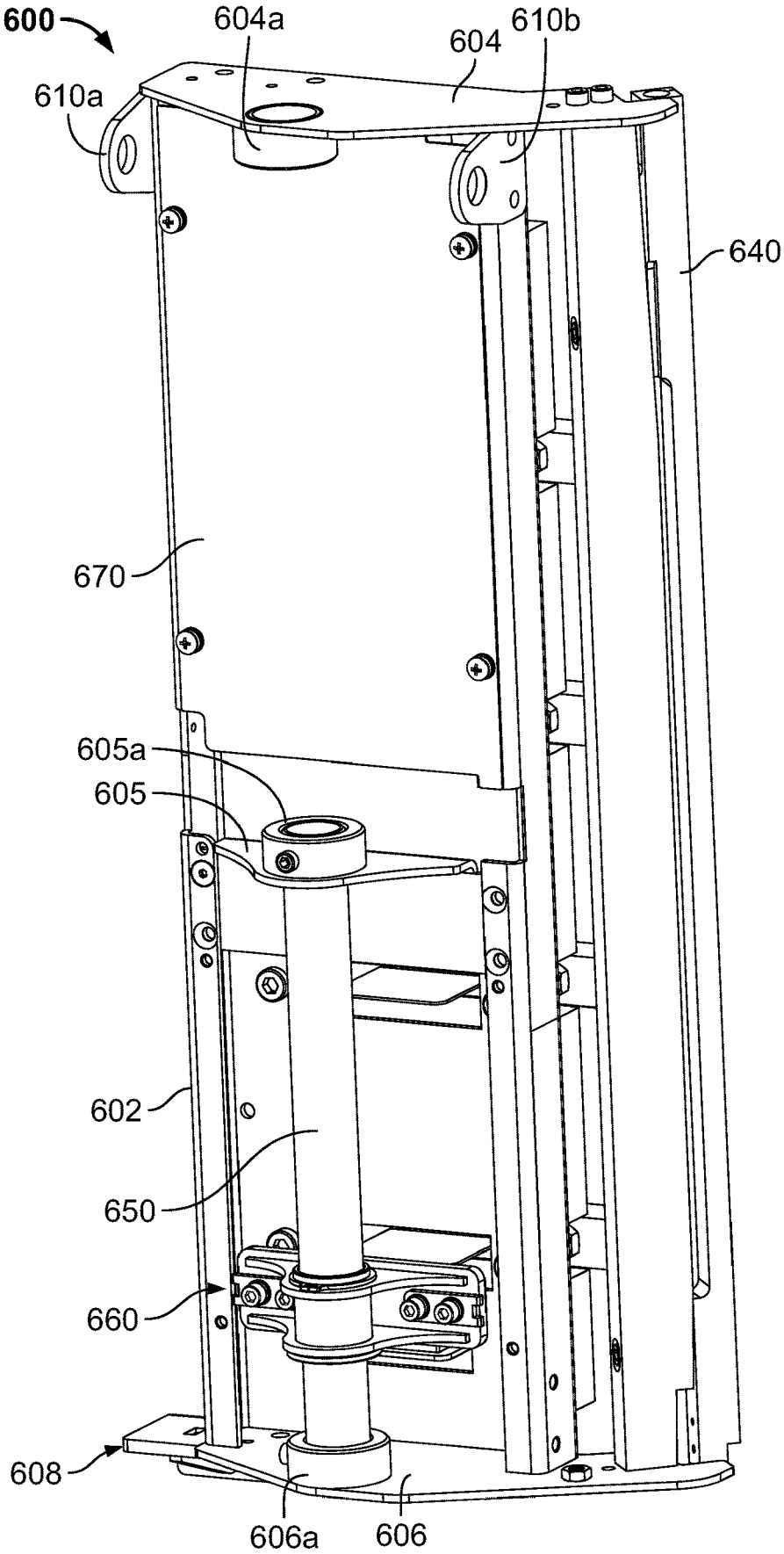
Figure 5C:
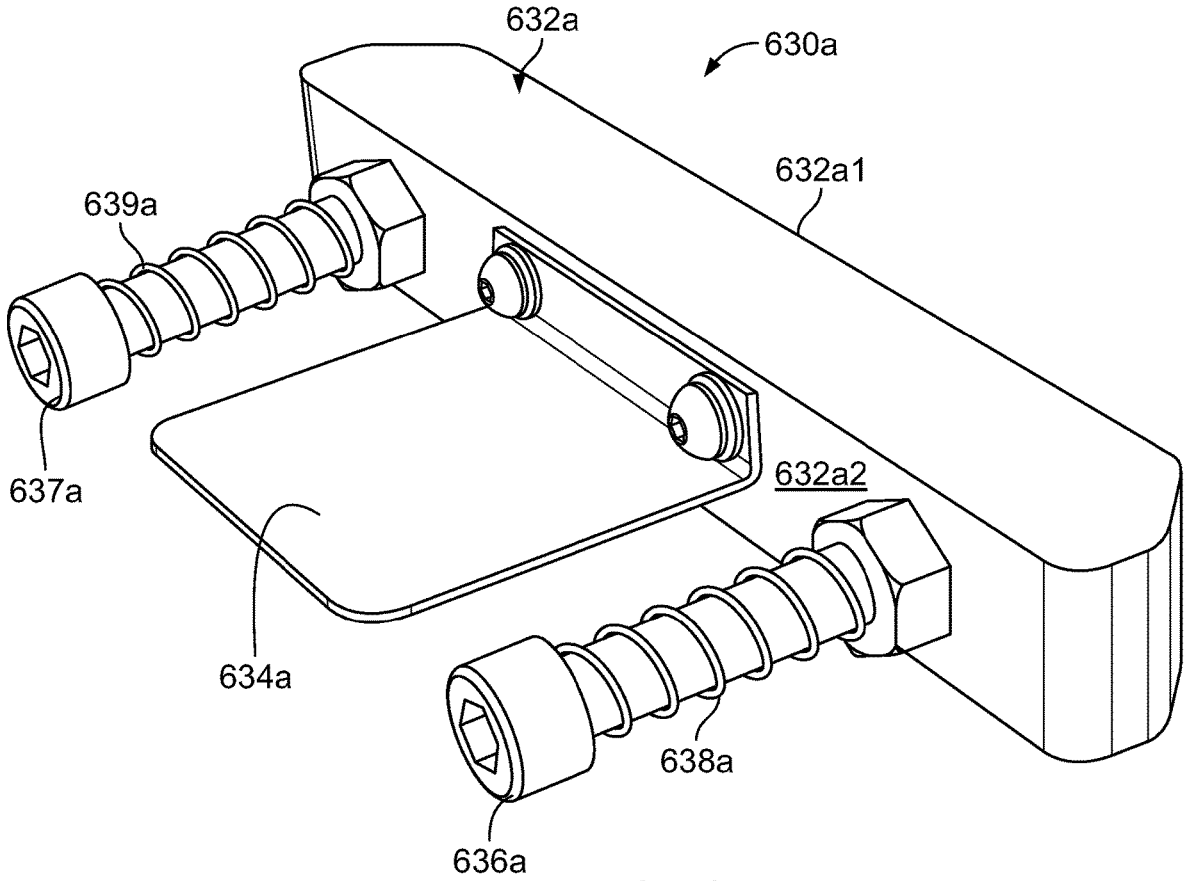
FIG. 5C is a perspective view of one of the seaming elements of the cut-and-seam assembly of FIGS. 5A and 5B.
Figure 5D:
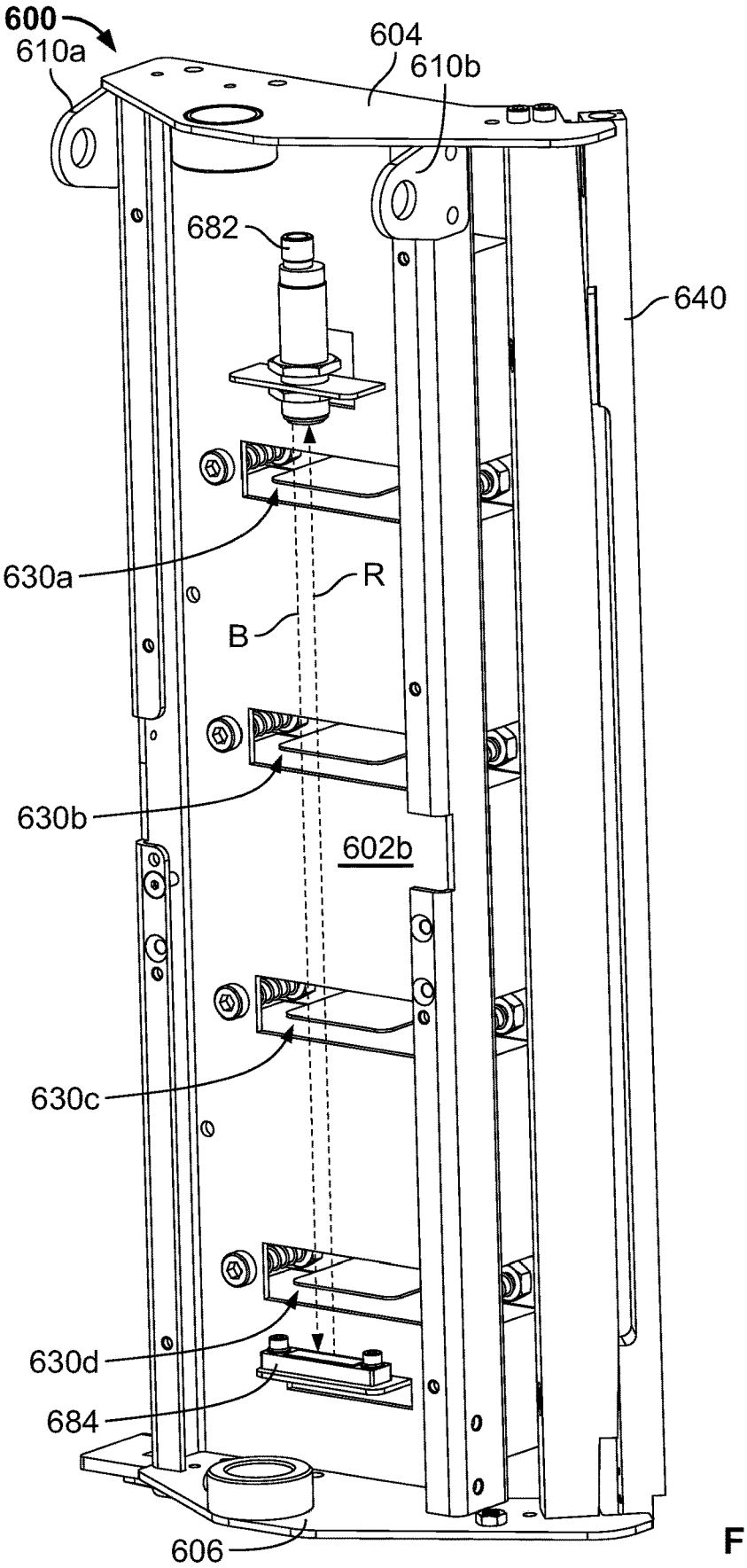
FIG. 5D is a perspective view of the cut-and-seam assembly of FIGS. 5A and 5B with certain components removed and the seaming elements in their rest configurations.

As best shown in FIG. 5D, the mounting plate 602 defines four plate-receiving openings therethrough (not labeled) sized to enable the plates of the four seaming elements 630*a*-630*d*, described below, to move therethrough in a reciprocating manner. These plate-receiving openings are vertically spaced apart and laterally centrally aligned (relative to the mounting plate 602) to correspond to the vertical spacing and central alignment of the seaming elements 630*a*-630*d*. The reflector 684 is mounted to the inner surface 602*b* of the mounting plate 602 below the lowermost plate-receiving opening. The photocell 682 is mounted to the inner surface 602*b* of the mounting plate 602 above the uppermost plate-receiving opening. The photocell 682 and the reflector 684 are oriented such that the reflector 684 reflects the beam B the photocell 682 transmits back to the receiver of the photocell 682.

The photocell 682 is electrically connected to a power source that powers the photocell 682. The controller 410 is communicatively connected to the photocell 682 so the photocell 682 can transmit signals to the controller 410 that enable the controller 410 to control certain components of the wrapping machine 10 in response. More specifically, in operation, the photocell 682 is configured to transmit a signal to the controller 410 responsive to the photocell 682 detecting that the beam has been interrupted and, thereafter, to transmit a signal to the controller 410 responsive to the photocell 682 again detecting the beam.

As best shown in FIG. 5B, the cover plate 670 is connected to the mounting plate 602 to generally cover the photocell 682 and the reflector 684.

The first, second, third, fourth, and fifth pads 620*a*-620*c* are connected to the outer surface 602*a* of the mounting bracket 602. The pads 620*a*-620*e* have a rectangular parallelepiped shape and are formed from a compliant material, such as foam, which enables the pads 620*a*-620*e* to deform when contacting the load so as not to damage the film wrapped around the load.

In this example embodiment, the seaming elements 630*a*-630*d* are identical, FIG. 5C shows one of the seaming elements 630*a*. The seaming element 630*a* includes a seaming bar 632*a* having a seaming surface 632*a*1 and a rear surface 632*a*2, a plate 634*a*, a first fastener 636*a*, a second fastener 637*a*, a first biasing element 638*a*, and a second biasing element 639*a*.

The plate 634*a* is connected to the seaming bar 632*a* and extends rearward, away from the rear surface 632*a*2 of the seaming bar 632*a*. Similarly, the first and second fasteners 636*a* and 637*a* are connected to (such as threadably received by) the seaming bar 632*a* and extend rearward, away from the rear surface 632*a*2 of the seaming bar 632*a*. The first biasing element 638*a*—a spring in this example embodiment—surrounds the shaft (not labeled) of the first fastener 636*a* and is retained in place between the head (not labeled) of the first fastener 636*a* and the seaming bar 632*a*. The second biasing element 639*a*—a spring in ibis example embodiment—surrounds the shaft (not labeled) of the second fastener 637*a* and is retained in place between the head (not labeled) of the second fastener 637*a* and the seaming bar 632*a*.

The seaming bar 632*a* includes a resistive heating element (such as a hot wire) configured to heat up when an electrical current travels through the resistive heating element. The seaming bar 632*a* is electrically connectable (under control of the controller 410, as explained below) to a power source to enable the resistive heating element to be heated when desired to cause the resistive heating element to locally melt two or more layers of film to fuse them together to attach the trailing end of the film to part of the film already wrapped around the load, as explained below. This is merely one example seaming bar, and any suitable manner of locally melting the film (such as hot air) may be employed in other embodiments.

Figure 5E:
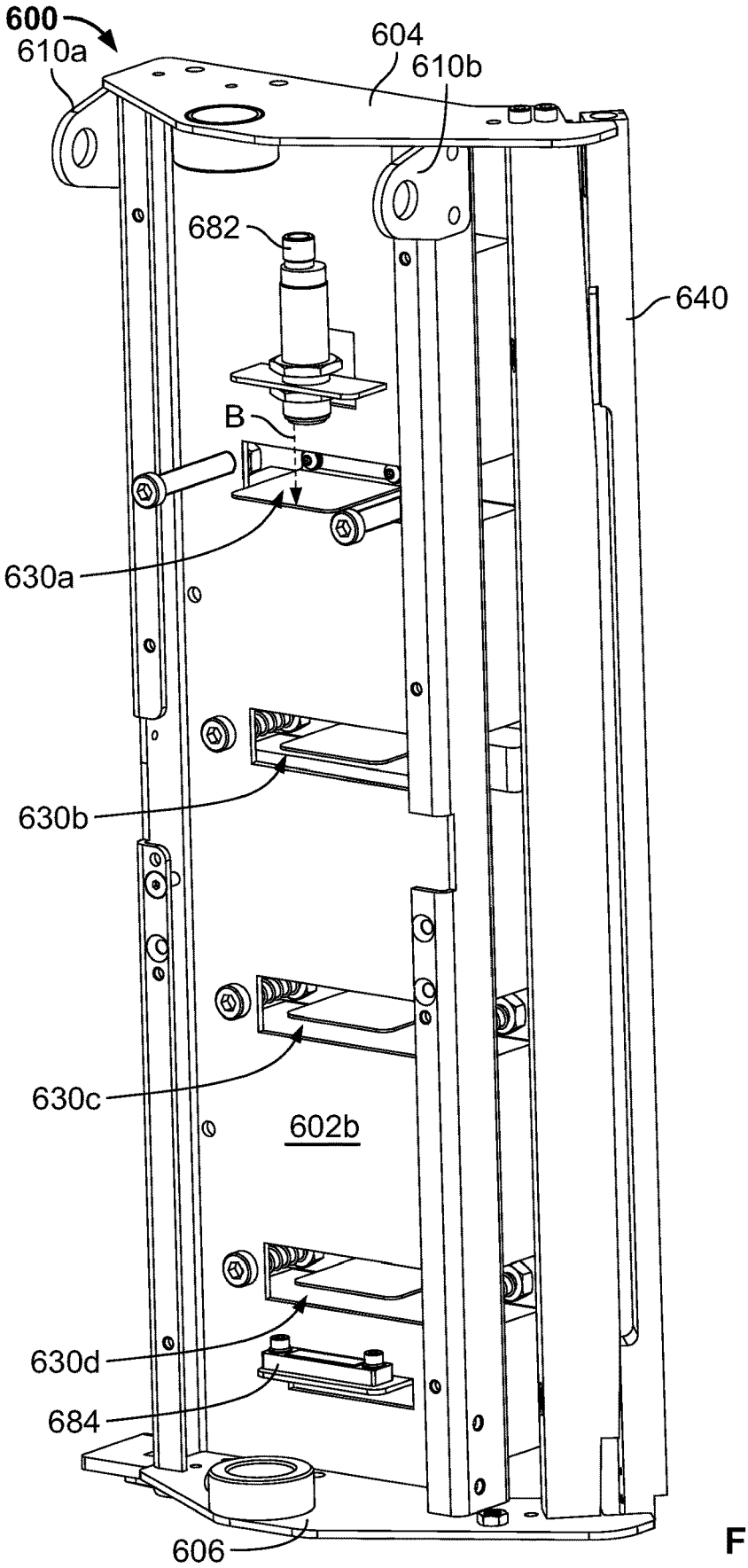
FIG. 5E is a perspective view of the cut-and-seam assembly of FIGS. 5A and 5B with certain components removed and one of the seaming elements in its actuated configuration.

As best shown in FIGS. 5D and 5E, the first seaming element 630*a* is mounted to the mounting plate 602 between the first and second pads 630*a* and 630*b* and movable between a rest configuration (FIG. 5D) and an actuating configuration (FIG. 5E). Specifically, the first seaming element 630*a* is mounted to the mounting plate 602 such that, when in the rest configuration: (1) the seaming bar 632*a*, the first and second biasing elements 638*a* and 639*a*, and the shafts (not labeled) of the first and second fasteners 636*a* and 637*a* are positioned on the outer surface 602*a* side of the mounting plate 602; and (2) the heads (not labeled) of the first and second fasteners 636*a* and 637 are positioned on the inner surface 602*b* side of the mounting plate 602.

As shown in FIG. 5D, the biasing elements 638*a* and 639*a* bias the first seaming element 630*a* to the rest configuration in which the first and second biasing elements 638*a* and 639*a* are generally extended, the seaming surface 632*a*1 of the seaming bar 632*a* extends past the outermost surfaces of the pads 630*a*-630*c*, and the plate 634*a* docs not break the beam B transmitted by the photocell 682. As shown in FIG. 5E, when the first seaming element 630*a* is in the actuating configuration, the seaming surface 632*a*1 of the seaming bar 632*a* is generally coplanar with the outermost surfaces of the pads 63O*a*-630*c*, the first and second biasing elements 638*a* and 639*a* are relatively compressed, and the plate 634*a* breaks the beam B transmitted by the photocell 682.

The second seaming element 630*b* is mounted to the mounting plate 602 between the second and third pads 630*b* and 630*c* in a similar manner. The third seaming element 630*c* is mounted to the mounting plate 602 between the third and fourth pads 630*c* and 630*d* in a similar manner. The fourth seaming element 630*d* is mounted to the mounting plate 602 between the fourth and fifth pads 630*d* and 630*c* in a similar manner. The seaming elements 630*a*-630*d* are therefore independently mounted to the mounting plate 602 and independently movable between their respective rest and actuating positions.

The cutting element 640 is connected to and extends between the upper and lower brackets 604 and 606. The cutting element 640 includes a resistive heating element (such as a hot wire) configured to heat up when an electrical current travels through the resistive heating element. The cutting element 640 is electrically connectable (under control of the controller 410, as explained below) to a power source to enable the resistive heating element to be heated when desired to cause the resistive heating element to cut the film from the film supply, as explained below. This is merely one example cutting element, and any suitable cutting element (such as a blade) may be employed in other embodiments.

As best shown in FIG. 5B, the connector mounting shaft 650 (which includes a suitable solid or tubular element having a circular (or other suitably shaped) cross section) is mounted to the intermediate and lower brackets 605 and 606 and oriented transversely thereto. More specifically: (1) a first (upper) end of the connector mounting shaft 650 is received in and connected to (such as via a set screw) a tubular connector mounting shaft receiver 605*a* of the intermediate bracket 605; and (2) a second (lower) end of the connector mounting shaft 650 is received in and connected to (such as via a set screw) a tubular connector mounting shaft receiver 606*a* of the lower bracket 606. The upper bracket 604 also includes a connector mounting shaft receiver 604*a*. In other embodiments, the connector mounting shaft is connected to the upper and intermediate brackets rather than the lower and intermediate brackets.

The actuating assembly connector 660 is slidably mounted to the connector mounting shaft 650 and movable along and relative to the connector mounting shaft between a lower position adjacent the connector mounting shaft receiver 606*a* and an upper position adjacent the connector mounting shaft receiver 605*a*.

Figure 6:
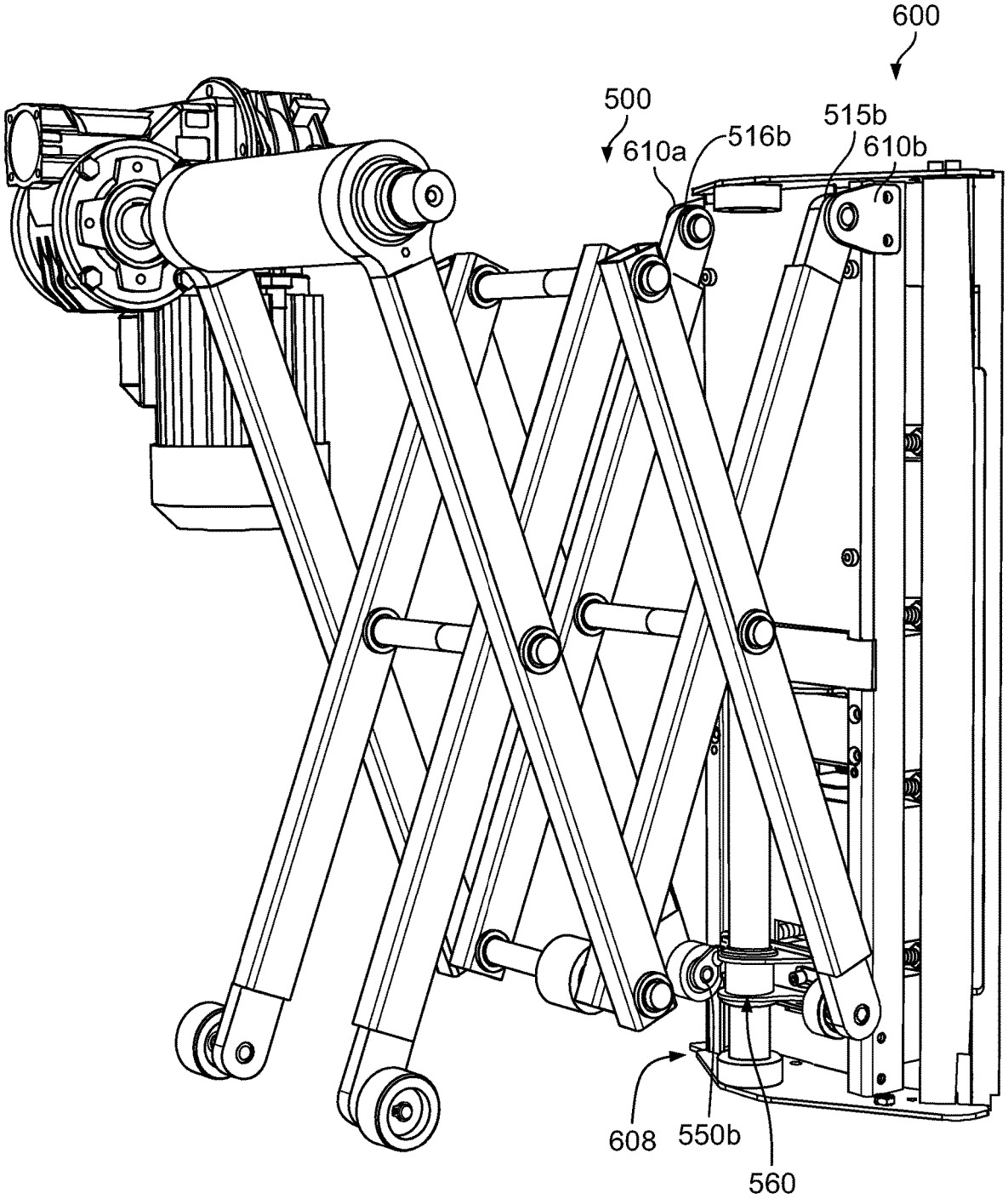
FIG. 6 is a perspective view of the actuating assembly of FIGS. 4A-4C with the cut-and-seam assembly of FIGS. 5A and 5B mounted thereto.

FIG. 6 shows the cut-and-seam assembly 600) mounted to the actuating assembly 500. Specifically, the second ends 515*b* and 516*b* of the fifth and sixth links 515 and 516 of the actuating assembly are rotatably connected to the first and second actuating-assembly-mounting brackets 610*a* and 610*b*, respectively, via suitable shafts (not labeled) such that the fifth and sixth links 515 and 516 can rotate around those shafts. Additionally, mounting components (not labeled) of the first and second connector engagers 550*a* and 550*b* of the actuating assembly 500 are received by the actuating assembly connector 660 of the cut-and-seam assembly 600. As the actuating assembly 500 moves among the film-release, intermediate, and seaming configurations (explained below), the first and second connector engagers 550*a* and 550*b* force the actuating assembly connector 660 to slide vertically along the connector mounting shaft 650.

Figure 7:
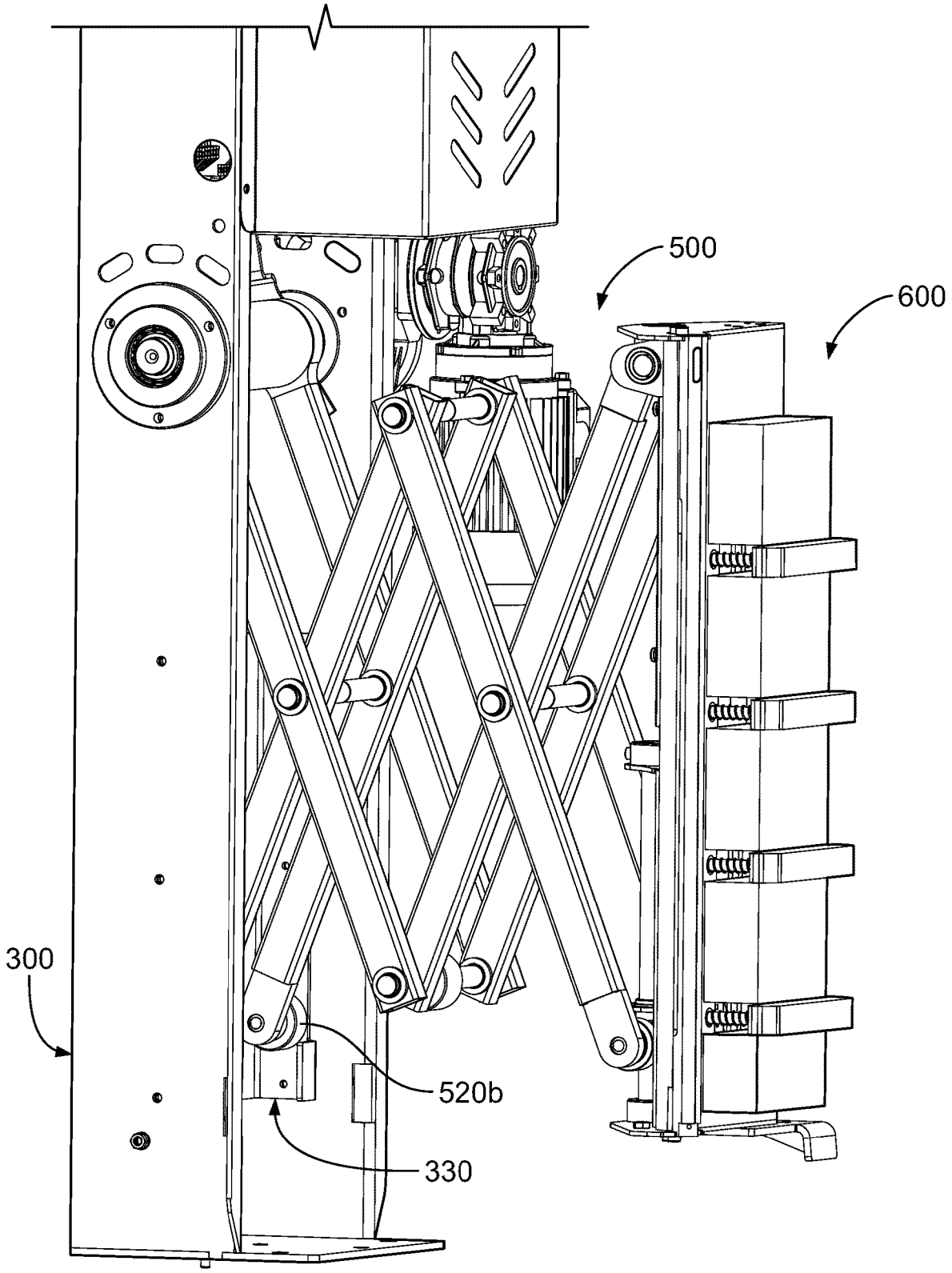
FIG. 7 is a perspective view of the actuating assembly of FIGS. 4A-4C (with the cut-and-seam assembly of FIGS. 5A and 5B mounted thereto) mounted to the mounting assembly of the wrapping machine of FIG. 1.

FIG. 7 shows the actuating assembly 500 (with the cut-and-seam assembly 600 mounted thereto) mounted to the mounting bracket 310 of the mounting assembly 300. The drive shaft 504 and the sleeve 506 are mounted to and extend between the first and second side walls 313 and 314 of the mounting bracket 310 via suitable plates and bearings (or in any other suitable manner) such that the drive shaft 504 and the sleeve 306 are rotatable relative to the first and second side walls 313 and 311. Additionally, the first roller 520*a* engages the rear wall 322 of the first roller-receiving bracket 320 (not shown), and the second roller 520*b* engages the rear wall 332 of the second roller-receiving bracket 330. As the actuating assembly 500 moves among the film-release, intermediate, and seaming configurations (explained below), the first and second rollers 520*a* and 520*b* roll vertically along the respective rear walls 322 and 332 of the first and second roller-receiving brackets 320 and 330.

The film-release assembly 700 is configured to cause the film-hold-and-release assembly 900 to release the part of the leading end of the film during the wrapping process. As best shown in FIGS. 8A-8E, the film-release assembly 700 includes: a guide 710, a film releaser 720, a guiding element 730, a lever 740, a lever-mounting bracket 750, and a film-releaser-biasing element 760.

Figure 8A:
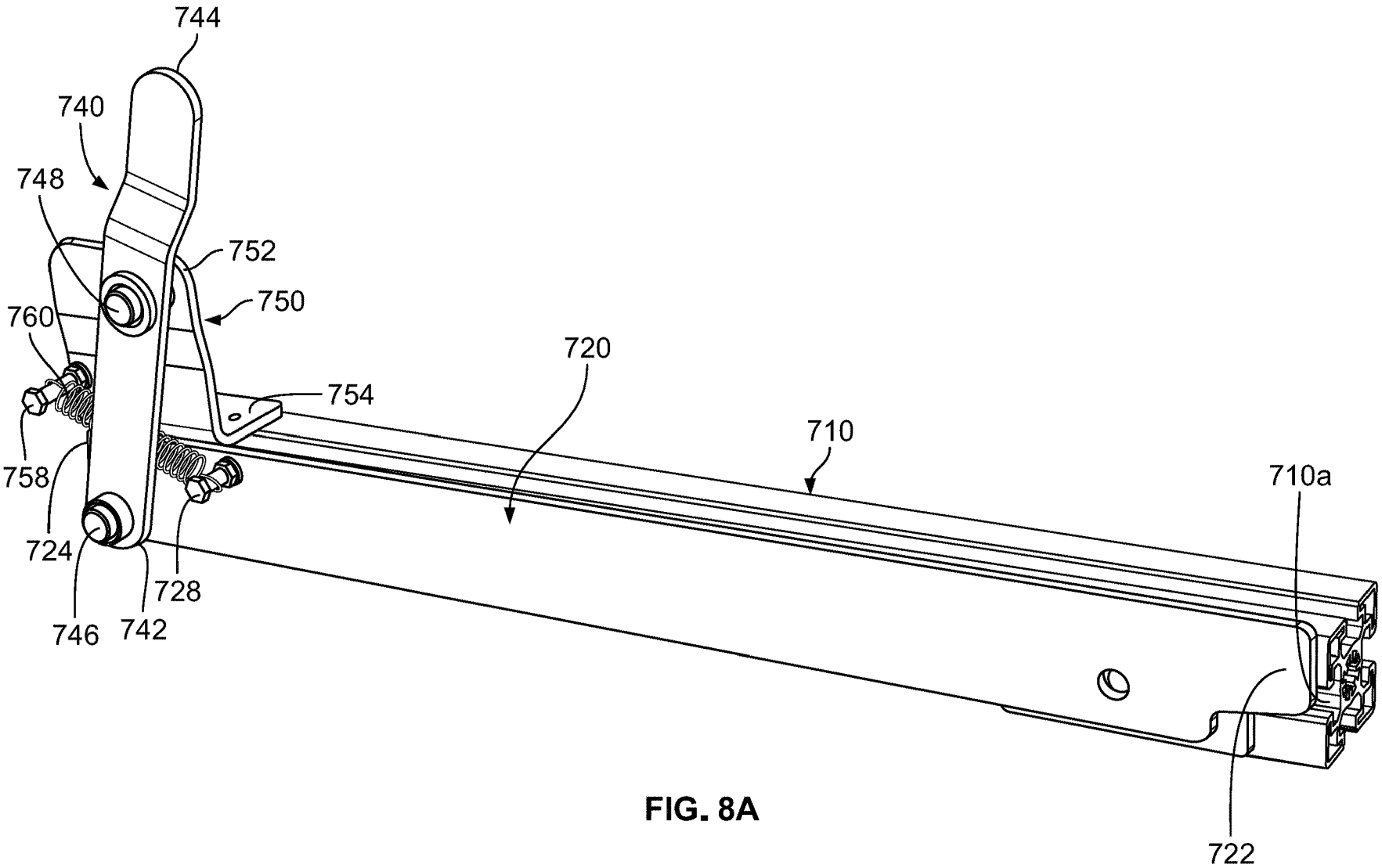
FIGS. 8A and 8B are perspective views of the film-release assembly of the wrapping machine of FIG. 1 in the rest configuration.
Figure 8B:
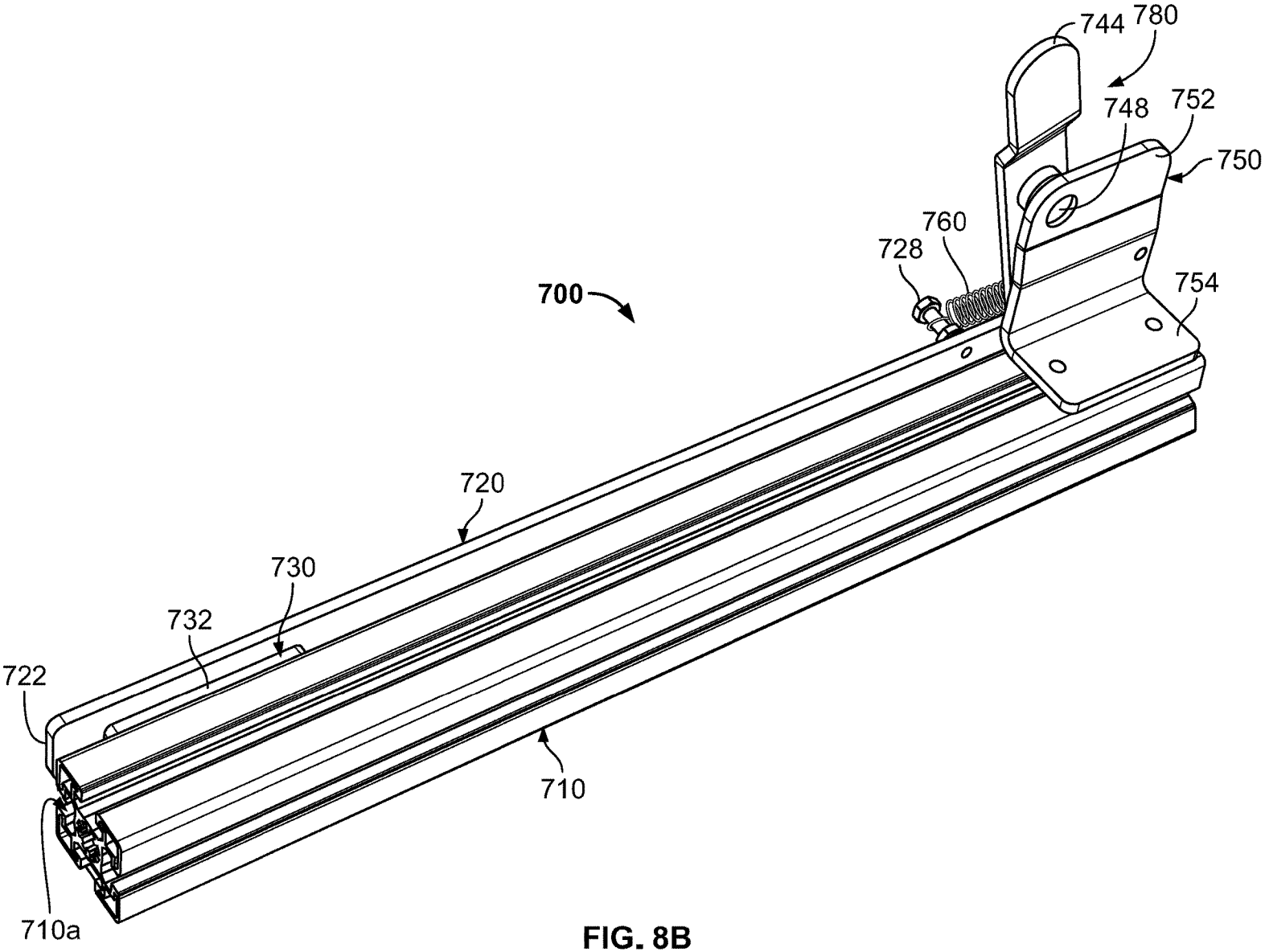
Figure 8C:
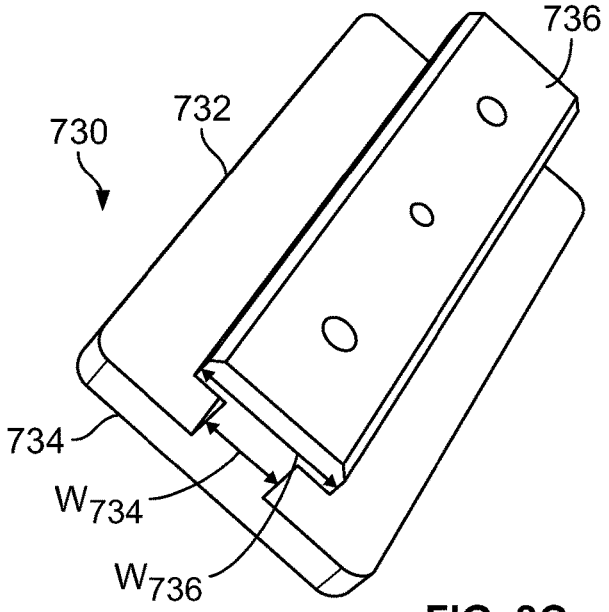
FIG. 8C is a perspective view of the guiding element of the film-release assembly of FIGS. 8A and 8B.

The guide 710 is an elongated member that defines a longitudinal channel 710*a* sized and shaped to slidably receive a neck 734 and a head 736 of the guiding element 730, as explained below. The film releaser 720 has a generally rectangular body with a first end 722 and an opposing second end 724. A first biasing-element mount 728 extends from the body between the first and second ends 722 and 724. As best shown in FIG. 8C, the guiding element 730 includes the elongated rectangular base 732, the elongated neck 734 extending transversely from the base 732, and an elongated head 736 atop the neck 734. The width of the head $W_{736}$ is greater than the width of the neck $W_{734}$.

Figure 8D:
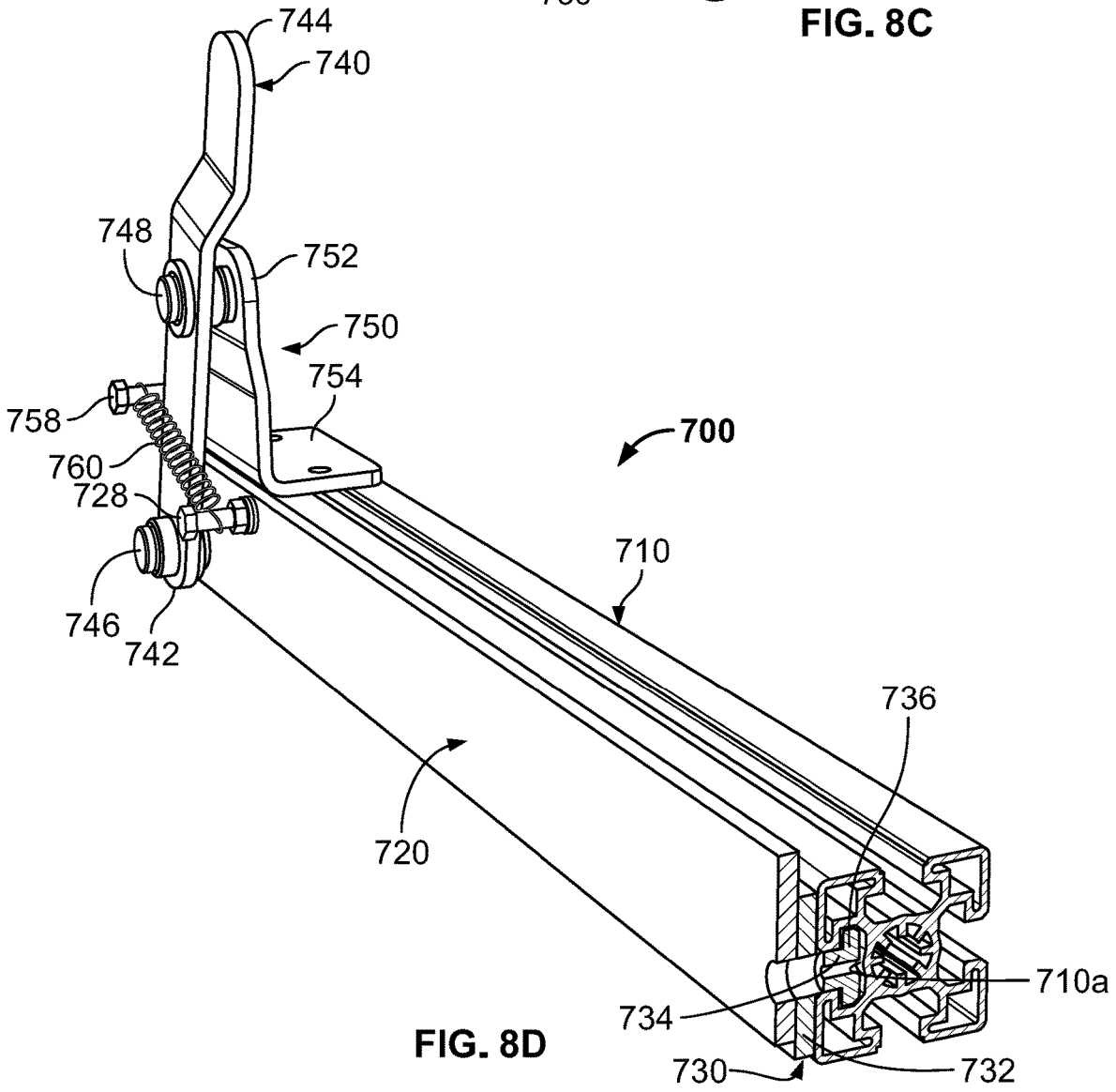
FIG. 8D is a perspective cross-sectional view of the film-release assembly of FIGS. 8A and 8B taken substantially along line 8D-8D of FIG. 8A.

As best shown in FIG. 8D, the neck 734 and the head 736 of the guiding element 730 are received in the channel 710*a* of the guide 710 to slidably mount the guiding element 730 to the guide 710 such that the guiding element 730 can move along and relative to the guide 710. The film releaser 720 is fixedly connected to the guiding element 730, such as via one or more fasteners, near the first end 722 of the film releaser 720. Accordingly, the film releaser 720 is slidably mounted to the guide 710 via the guiding element 730 such that the film releaser 720 can move along and relative to the guide 710.

The lever-mounting bracket 750 has a generally L-shaped body formed from a first leg 752 and a second leg 754 that is transverse to the first leg 752. The second leg 754 is fixedly connected to the guide 710, such as via suitable fasteners. A second biasing-element mount 758 extends from the first leg 752 and is generally parallel to the fastener 728.

The lever 740 has a generally rectangular body with a first end 742 and an opposing second end 744. The first end 742 of the lever 740 is rotatably connected via a first shaft 746 to the second end 724 of the film releaser 720 such that the lever 740 can rotate relative to the film releaser 720. A portion of the lever 740 between the first and second ends 742 and 744 is also rotatably connected via a second shaft 748 to the first leg 752 of the lever-mounting bracket 750 such that the lever 740 can rotate relative to the lever-mounting bracket 750. The lever 740 extends between the biasing-element mounts 728 and 758.

Figure 8E:
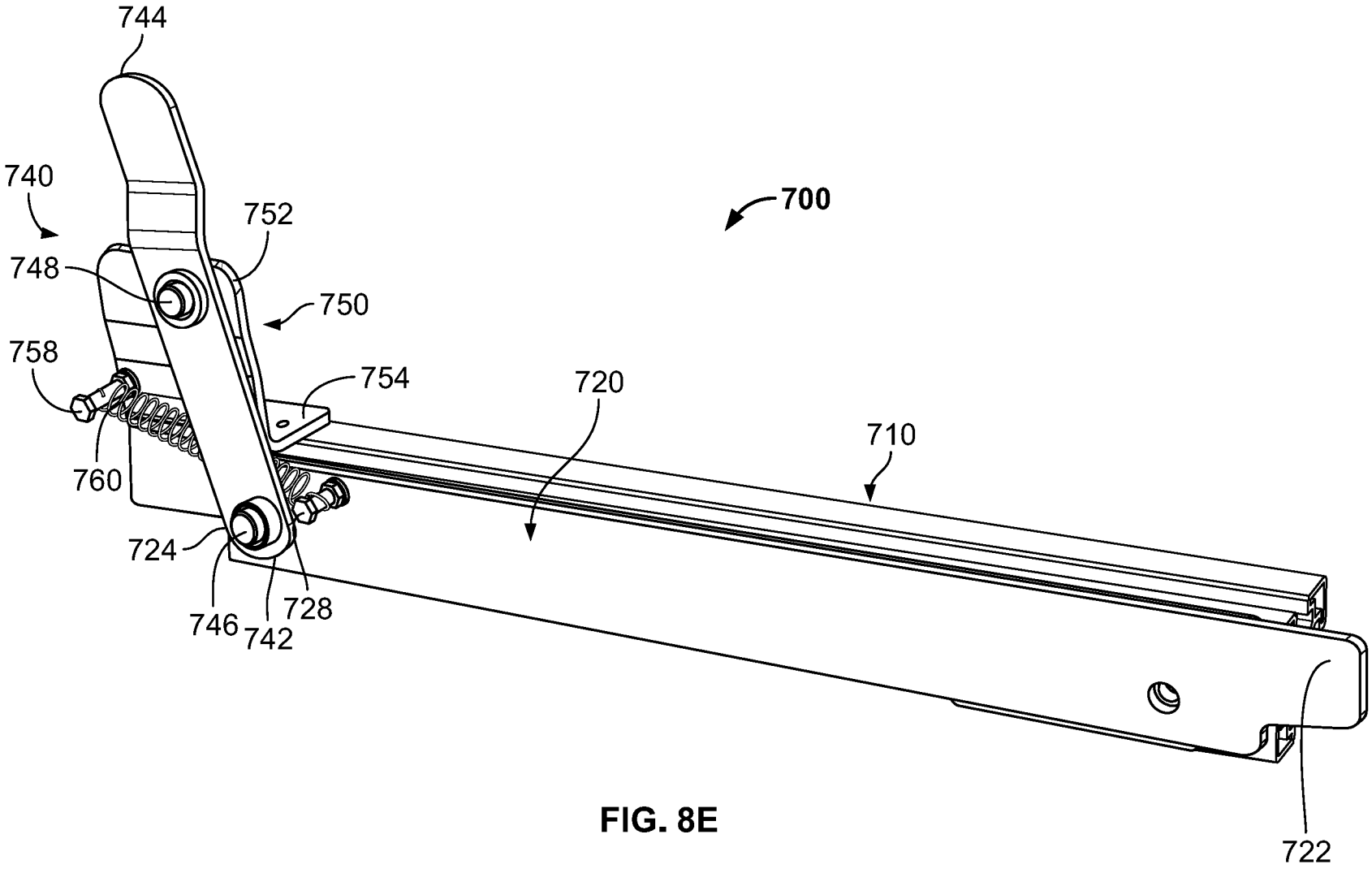
FIG. 8E is a perspective view of the film-release assembly of FIGS. 8A and 8B in the film-release configuration.

The film-releaser-biasing element 760—which includes a spring in this embodiment—is connected to and extends between the fasteners 728 and 758. The film-releaser-biasing element 760 biases the film-release assembly 700 to a rest configuration in which the film releaser 720 and the lever 740 are in respective rest positions, as shown in FIG. 8A. Rotation of the lever 740 counter-clockwise (i.e., toward the biasing-element mount 758) causes the film-release assembly to move into a film-release configuration in which the lever 740 and the film releaser 720 are in respective film-release positions, as shown in FIG. 8E. Once the lever 740 is released, the film-releaser-biasing element 760 biases the film releaser 720 back to the rest position, which in turn causes the lever 740 to return to the rest position such that the film-release assembly 700 is in the rest configuration.

FIGS. 9A-9C show the interrelationship of the actuating assembly 500, the cut-and-seam assembly 600, and the film-release assembly 700. In FIGS. 9A-9C, the cut-and-seam assembly 600 is mounted to the actuating assembly 500), which is itself mounted to the mounting assembly 300. The film-release assembly 700 is mounted (such as via suitable fasteners and mounting plates, not shown) to the base 100 and to the mounting assembly 300.

FIG. 9A shows the actuating assembly 500 in a film-release configuration, the cut-and-seam assembly 600 in a film-release position, and the film-release assembly 700 in the film-release configuration. Specifically, when the actuating assembly 500 is in the film-release configuration, the film-release-assembly engager 530 of the actuating assembly 500 engages the second end 744 of the lever 740 of the film-release assembly 700 such that the lever 740 is maintained in its film-release position. This, in turn, maintains the film releaser 720 in its film-release position and therefore maintains the film-release assembly 700) in its film-release configuration. Additionally, when the actuating assembly 500 is in the film-release configuration, the cut-and-seam assembly 600 is in the film-release position.

FIG. 9B shows the actuating assembly 500 in an intermediate configuration, the cut-and-seam assembly 600 in an intermediate position, and the film-release assembly 700 in the rest configuration. Specifically, when the actuating assembly 500 is in the intermediate configuration, the film-release-assembly engager 530 does not engage (i.e., is spaced-apart from) the lever 740 of the film-release assembly 700. Accordingly, the film releaser biasing element 760 maintains the lever 740 and the film releaser 720 in their respective rest positions and therefore the film-release assembly in its rest configuration. Additionally, when the actuating assembly 500 is in the intermediate configuration, the cut-and-seam assembly 600 is in the intermediate position.

FIG. 9C shows the actuating assembly 500 in the seaming configuration, the cut-and-seam assembly 600 in the seaming position, and the film-release assembly 700 in the rest configuration. Specifically, when the actuating assembly 500 is in the seaming configuration, the film-release-assembly engager 530 does not engage (i.e., is spaced-apart from) the lever 740 of the film-release assembly 700. Accordingly, the film-releaser-biasing element 760 maintains the lever 740 and the film releaser 720 in their respective rest positions and, therefore, the film-release assembly in its rest configuration. Additionally, when the actuating assembly 500 is in the seaming configuration, the cut-and-seam assembly 600 is in the seaming position.

As best shown in FIG. 1, the turntable assembly 800 includes a disc-shaped turntable 810 that has a circular perimeter $P_{810}$. The turntable 810 is rotatably mounted to the base 100 such that the turntable 810 is rotatable relative to the base 100. The turntable actuator 800*a* of the base 100 is operably connected to the turntable 810 (such as via suitable gearing and pulleys or chains) to rotate the turntable 810 relative to the base 100.

The film-hold-and-release assembly 900 is configured to hold and (later) release part of the leading end of the film on the roll during the wrapping process. As best shown in FIGS. 10A-10D, the film-hold-and-release assembly 900 includes: an enclosure 902, a locking component receiver 903, a jaw-actuator-biasing-element mount 904, a first jaw-mounting bracket 906, a second jaw-mounting bracket 908, a jaw actuator 910, a jaw-actuator-biasing element 920, first and second jaws 930*a* and 930*b*, first and second shafts 940*a* and 940*b*, first and second gears 950*a* and 950*b*, first and second jaw-biasing-element mounts 955*a* and 955*b*, a jaw-biasing element 960, and a linkage 970.

The enclosure 902 includes an upper wall 902*a*, an opposing lower wall 902*b*, a front wall 902*c*, an opposing rear wall 902*d*, a first side wall 902*e*, and an opposing second side wall 902*f* that generally define an interior of the enclosure 902. Although not shown for clarity, the upper wall 902*a* is hingedly connected to the rear wall 902*d* such that the upper wall 902*a* is rotatable relative to the other walls between a closed position (FIG. 10A) and an open position (not shown) to enable exposureof the interior of the enclosure 902 and the components therein. The front wall 902*c* is curved to conform to the curve of the perimeter $P_{810}$ of the turntable 810 of the turntable assembly 800. That is, the radii of curvature of the front wall 902*c* and the perimeter $P_{810}$ of the turntable 810 are generally the same. The enclosure 902 is mounted (such as via suitable fasteners) to the turntable 810 such that the front wall 902*c* is generally aligned with the perimeter $P_{810}$ of the turntable 810.

Figure 10A:
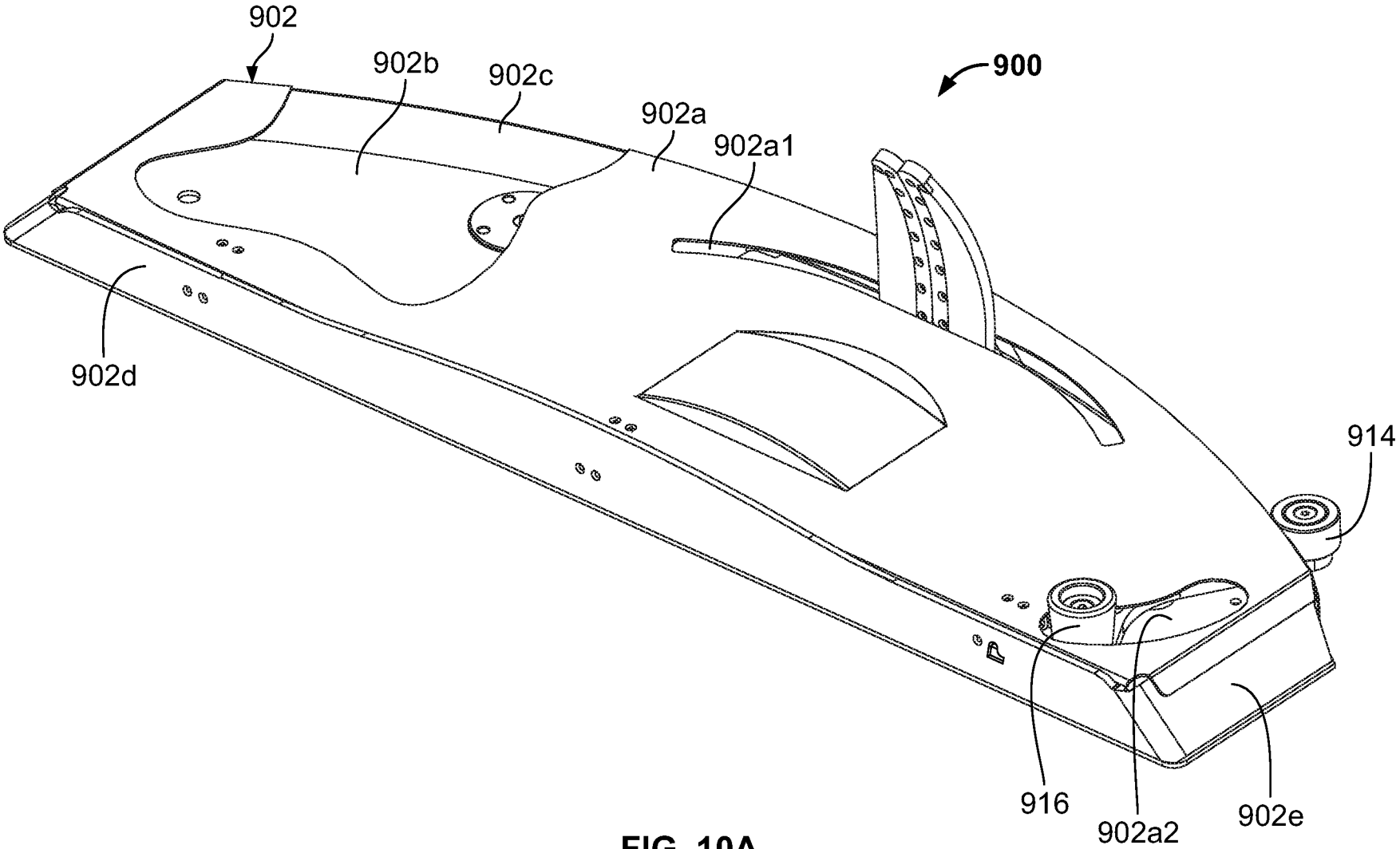
FIGS. 10A and 10B are perspective views of the film-hold-and-release assembly of the wrapping machine of FIG. 1.
Figure 10B:
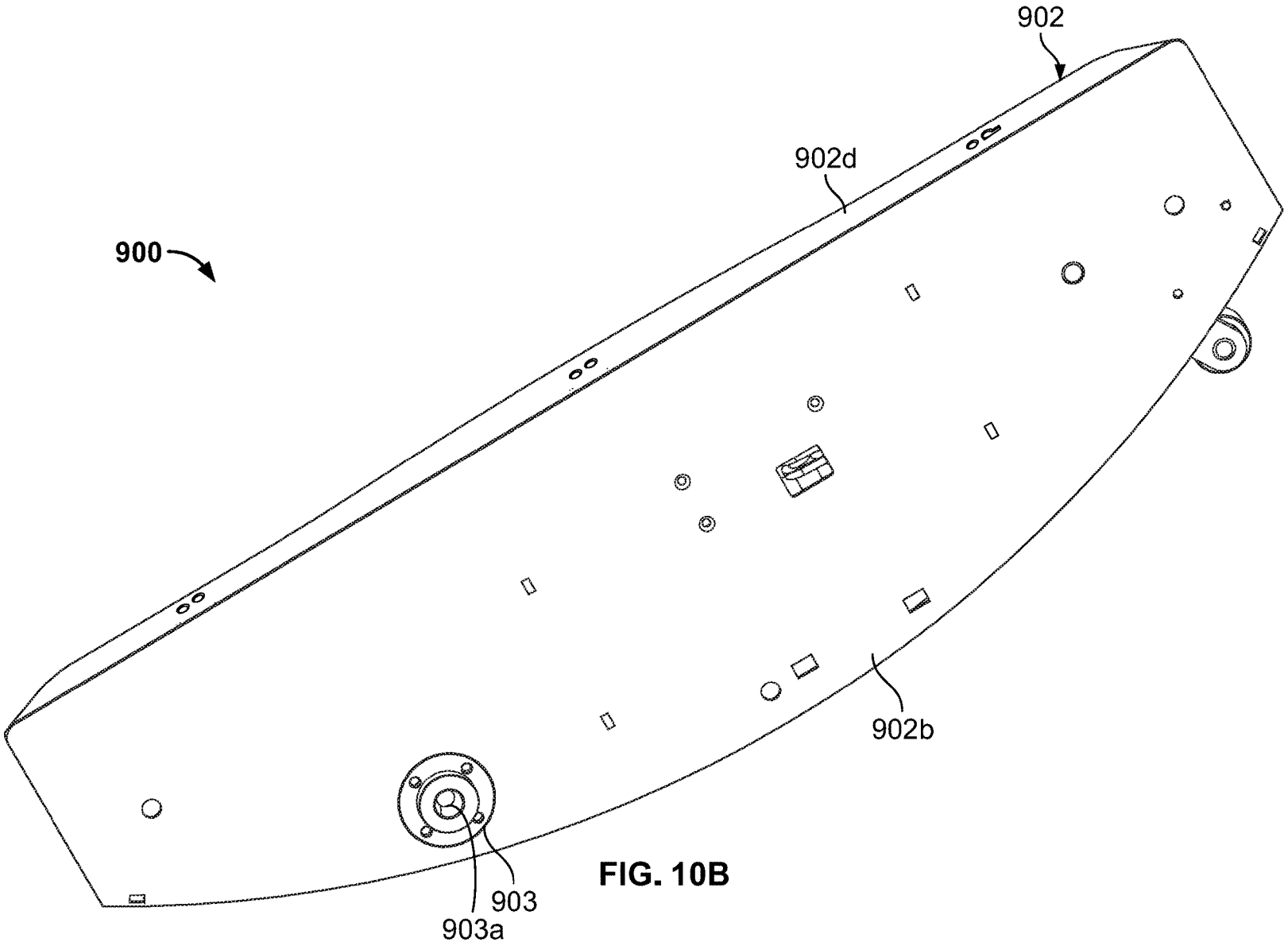
Figure 10C:
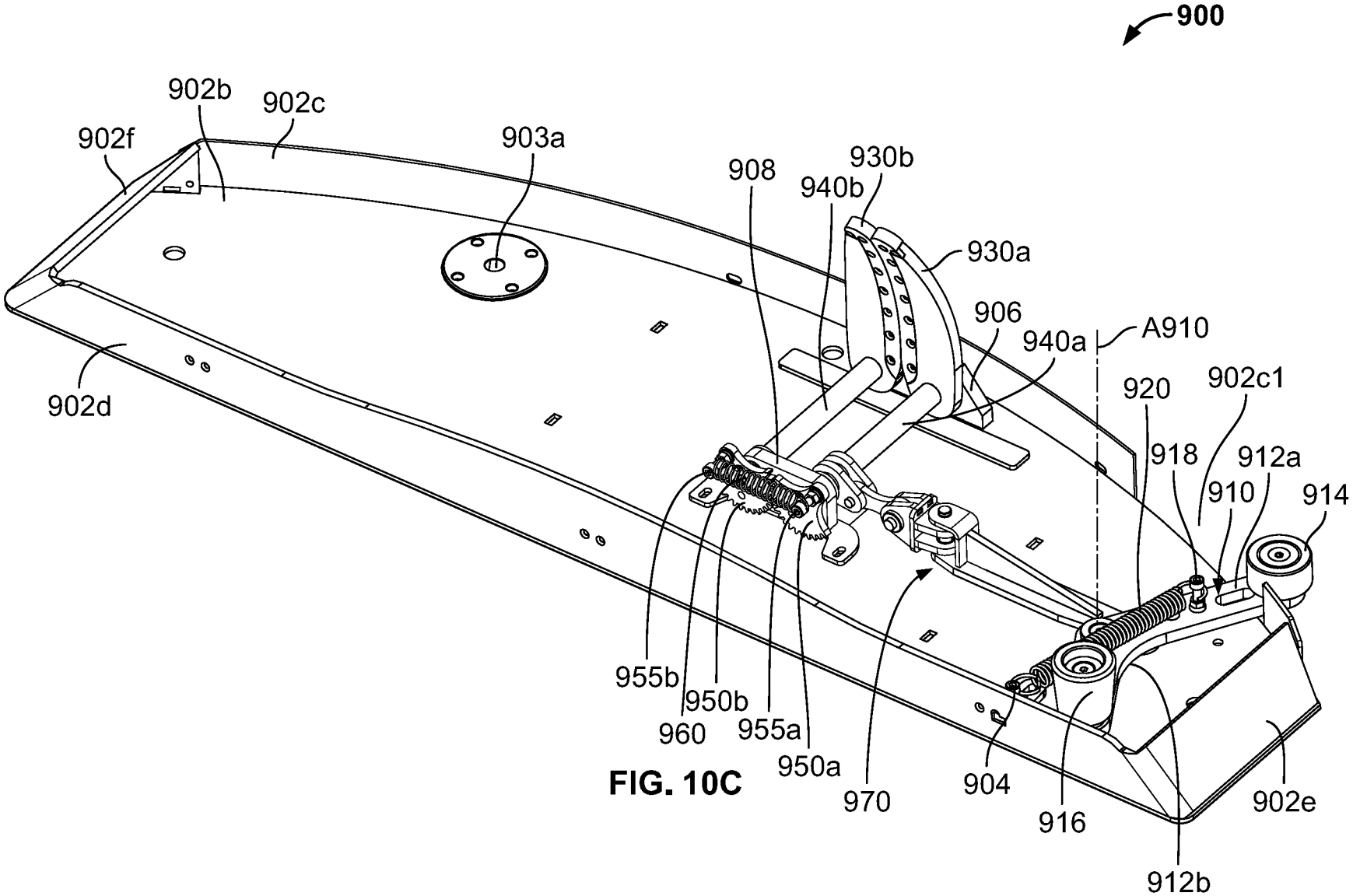
FIG. 10C is a perspective view of the film-and-clamping assembly of FIGS. 10A and 10B with certain components removed, the jaw actuator in a closed position, and the jaws in a closed configuration.

As shown in FIG. 10B, the locking-component receiver 903 is connected to the underside of the lower wall 902*b* and defines a locking-component-receiving bore 903*a* therethrough. The locking-component-receiving bore 903*a* is sized to receive the locking component 120 of the turntable-locking assembly (described above in conjunction with the base 100) to prevent the turntable assembly 800 from rotating, as explained below.

Figure 10D:
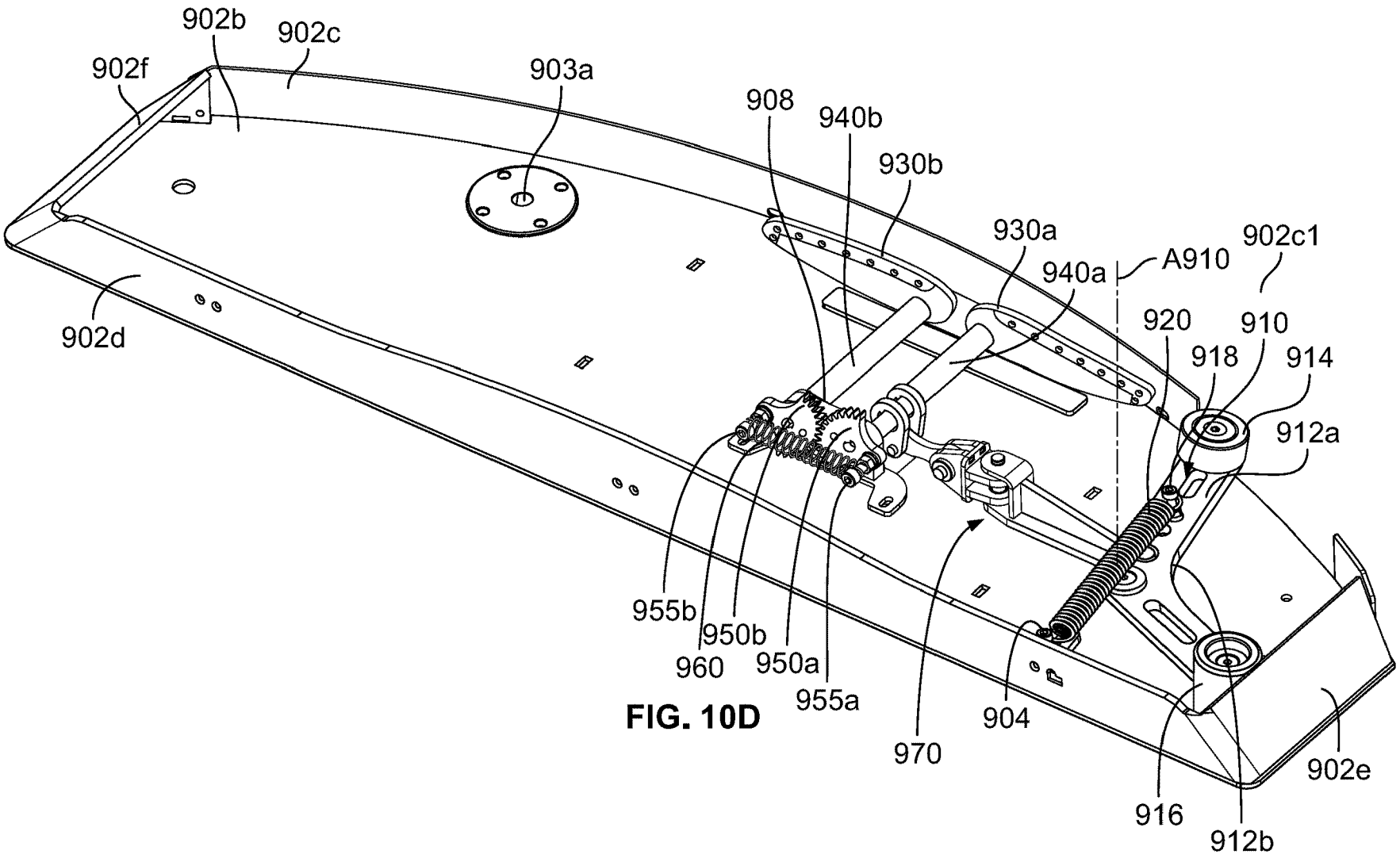
FIG. 10D is a perspective view of the film-hold-and-release assembly of FIGS. 10A and 10B with certain components removed, the jaw actuator in an open position, and the jaws in an open configuration.
Figure 11:
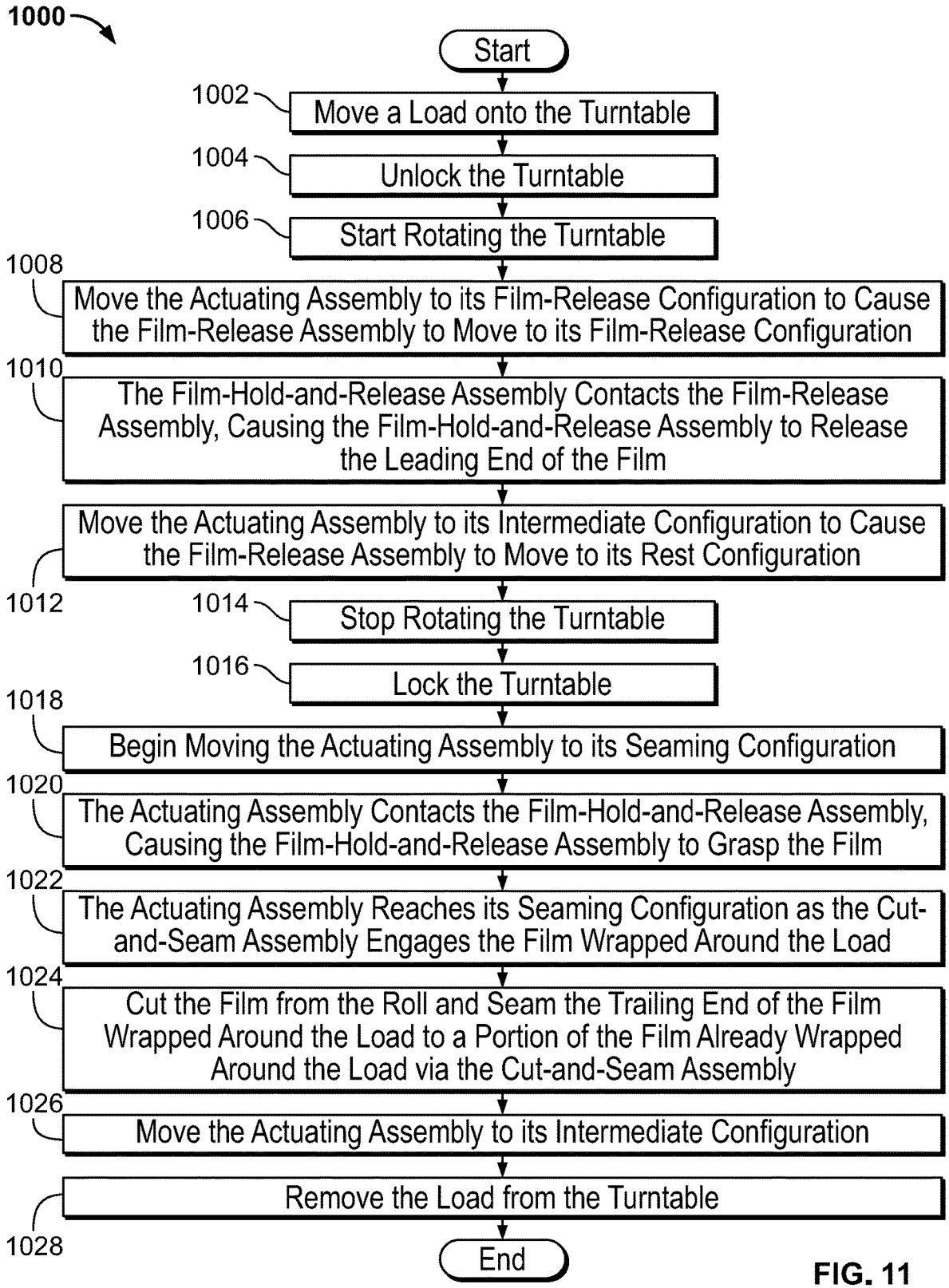
FIG. 11 is a flowchart showing a method of operating the wrapping machine of FIG. 1 to carry out a wrapping process.

The jaw actuator 910 includes a body formed from a first leg 912*a* and a second leg 912*b* that forms an oblique angle (or any other suitable angle) with the first leg 912*a*. An opening component 914—here a wheel—is rotatably mounted to a free end of the first leg 912*a*. A closing component 916—here a wheel—is rotatably mounted to a free end of the second leg 912*b*. The jaw actuator 910 is rotatably connected to the lower wall 902*b* of the enclosure 902 in a suitable manner such that the jaw actuator 910 is rotatable relative to the enclosure 902 about an axis $A_{910}$ between a jaw-closed position (FIG. 10C) and a jaw-open position (FIG. 10D). A jaw-actuator-biasing-element mount 918 is connected to the first leg 912*a* between the opening component 914 and the axis $A_{910}$.

The jaw actuator 910 is positioned such that, when in the jaw-closed position, the first leg 912*a* extends through an opening component opening 902*c*1 defined through the front wall 902*c* such that all or part of the opening component 914 is outside the enclosure 902. This enables the film releaser 720 of the film-release assembly 700 to contact the opening component 914 to move the jaw actuator 910 from the jaw-open to the jaw-closed position, as explained below. When the jaw actuator 910 is in the jaw-open position, the opening component 914 is positioned within the interior of the enclosure 902 (i.e., does not extend through the opening component opening 902*c*1).

As best shown in FIG. 10A, the upper wall 902*a* defines a closing component opening 902*a*2 therethrough. The closing component 916 extends through the closing component opening 902*a*2 to enable the foot 608*b* of the film-hold-and-release assembly engager 608 of the cut-and-seam assembly 600 to contact the closing component 916 to move the jaw actuator 910 from the jaw closed to the jaw-open position, as explained below.

The jaw-actuator-biasing element 920—here a spring—is connected to the jaw-actuator-biasing-element mounts 904 and 918. The jaw-actuator-biasing element 920 is configured to bias the jaw actuator 910 to its current position. That is: (1) when the jaw actuator 910 is in the jaw-open position, the jaw-actuator-biasing element 920 biases the jaw actuator 910 to remain in the jaw-open position; and (2) when the jaw actuator 910 is in the jaw-closed position, the jaw-actuator-biasing element 920 biases the jaw actuator 910 to remain in the jaw-closed position.

The first and second jaw-mounting brackets 906 and 908 are connected to the lower wall 902*b* of the enclosure 902 in any suitable manner. The first shaft 940*a* is rotatably connected to and extends between the first and second jaw-mounting brackets 906 and 908 such that the first shaft 940*a* can rotate relative to the first and second jaw-mounting brackets 906 and 908. Similarly, the second shaft 940*b* is rotatably connected to and extends between the first and second jaw-mounting brackets 906 and 908 such that the second shaft 940*b* can rotate relative to the first and second jaw-mounting brackets 906 and 908.

The first jaw 930*a* is fixedly connected to the first shaft 940*a* (such as via a keyed or a splined connection; near one end of the first shaft 940*a* to rotate therewith. The first gear 950*a* is fixedly connected to the first shaft 940*a* (such as via a keyed or a splined connection) near the opposite end of the first shaft 940*a* to rotate therewith. Similarly, the second jaw 930*b* is fixedly connected to the second shaft 940*b* (such as via a keyed or a splined connection) near one end of the second shaft 940*b* to rotate therewith. The second gear 950*b* is fixedly connected to the second shaft 940*b* (such as via a keyed or a splined connection) near the opposite end of the second shaft 940*b* rotate therewith. The first and second gears 950*a* and 950*b* are meshed with one another such that rotation of one of the gears (and therefore rotation of the corresponding shaft and jaw) in one direction causes rotation of the other gear (and therefore rotation of the corresponding shaft and jaw) in the opposite direction.

The first gear 950*a* has a first shoulder that extends radially outward from the center of the first gear 950*a* and to which the first jaw biasing element mount 955*a* is connected. Similarly, the second gear 950*b* has a second shoulder that extends radially outward from the center of the second gear 950*b* and to which the second jaw-biasing-element mount 955*b* is connected. The jaw-biasing element 960 is connected to and extends between the first and second jaw-biasing element mounts 955*a* and 955*b*. The jaw-biasing element 960 biases the jaws 930*a* and 930*b* to a closed configuration shown in FIG. 10C.

The linkage 970 includes any suitable component (or set of components) that operably connects the jaw actuator 910 to the first shaft 940*a* such that: (1) movement of the jaw actuator 910 from the jaw-closed position to the jaw-open position causes the first shaft 940*a* to rotate to cause the first jaw 930*a* (via its fixed connection to the first shaft 940*a*) and the second jaw 930*b* (via the meshing of the gears 950*a* and 950*b*) to move from the closed configuration to the open configuration (FIG. 10C); and (2) movement of the jaw actuator 910 from the jaw-open position to the jaw-closed position causes the first shaft 940*a* to rotate to cause the first jaw 930*a* (via its fixed connection to the first shaft 940*a*) and the second jaw 930*b* (via the meshing of the gears 950*a* and 950*b*) to move from the open configuration to the closed configuration (FIG. 10D).

A wrapping process 1000 in which the wrapping machine 10 is used to wrap a palletized load L with the film F is now described in conjunction with FIG. 11 and FIGS. 12A-12H.

Figure 12A:
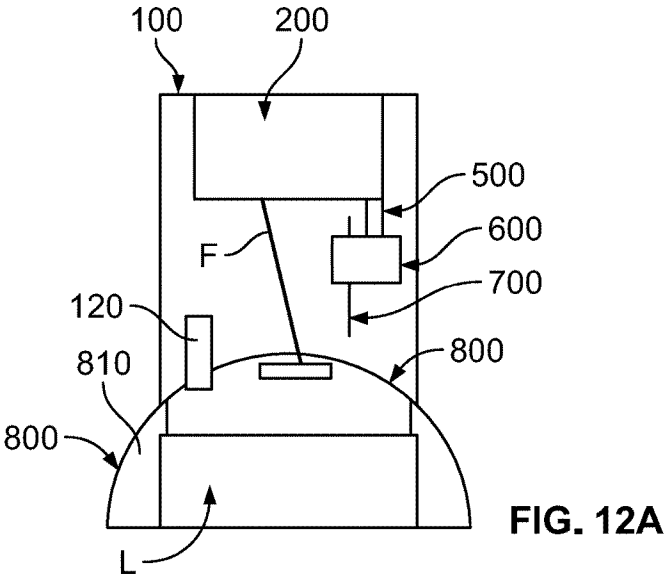
FIGS. 12A-12H are diagrammatic and fragmentary top plan views of certain components of the wrapping machine of FIG. 1 at different stages of the wrapping process of FIG. 11.
Figure 12B:
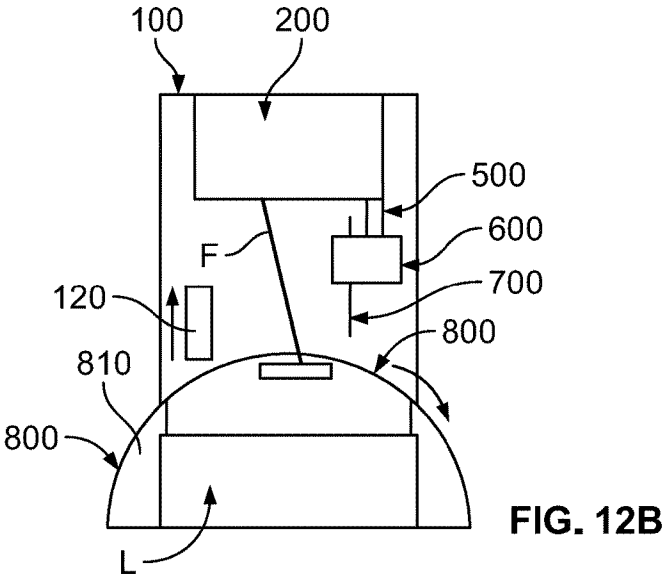

First, an operator moves a load L onto the turntable 810 of the turntable assembly 800, as block 1002 indicates and as shown in FIG. 12A. Responsive to receipt of an appropriate operator input, the controller 410 unlocks the turntable 810, as block 1004 indicates and as shown in FIG. 12B, by controlling the locking-component actuator 130 to move the locking component 120 from the locked position to the rest position. The controller 410 starts rotating the turntable 810, as block 1006 indicates and as shown in FIG. 12B, by controlling the turntable actuator 800*a* in the appropriate manner. This causes the film F to begin wrapping around the load L.

Figure 12C:
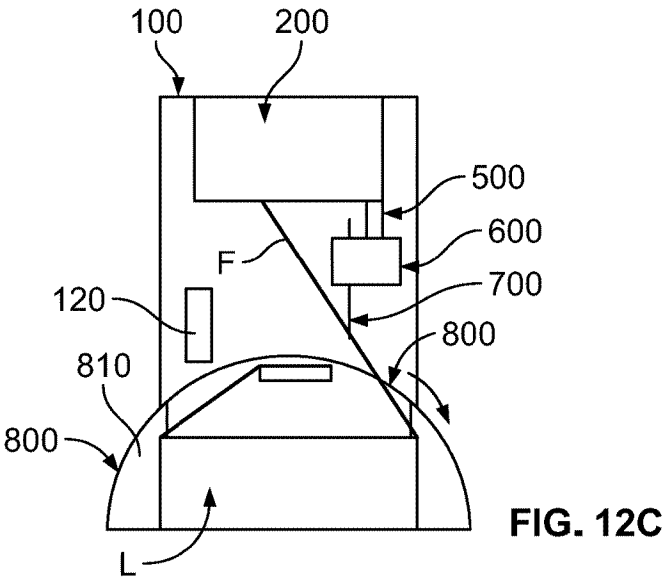
Figure 12D:
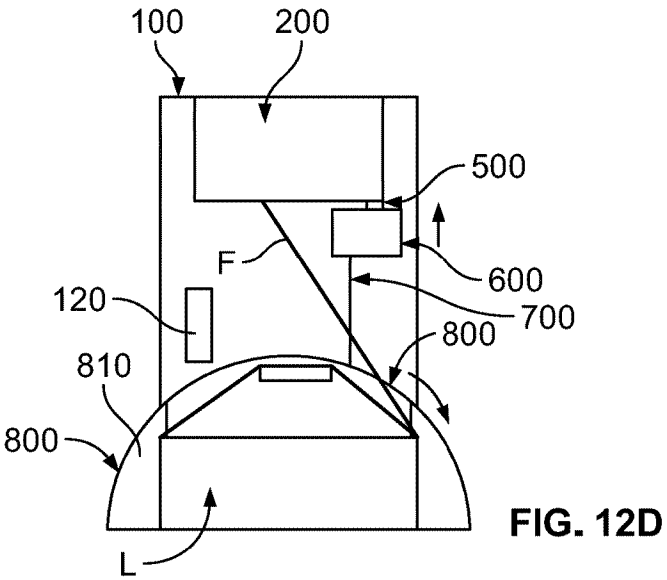

After the turntable 810 has rotated a first amount, as shown in FIG. 12C, the controller 410 starts moving the actuating assembly 500 from its intermediate configuration to its film-release configuration to cause the film-release assembly 700 to move from its rest configuration to its film-release configuration, as block 1008 indicates and as shown in FIG. 12D. Specifically, the controller 410 controls the actuating assembly actuator 502 to move the actuating assembly 500 into its film-release configuration. With the film-release assembly 700 in its film-release configuration, continued rotation of the turntable 810 causes the film-hold-and-release assembly 900 to contact the film-release assembly 700, which causes the film-hold-and-release assembly 900 to release the leading end of the film F, as block 1010 indicates and as shown in FIG. 12E.

Figure 12F:
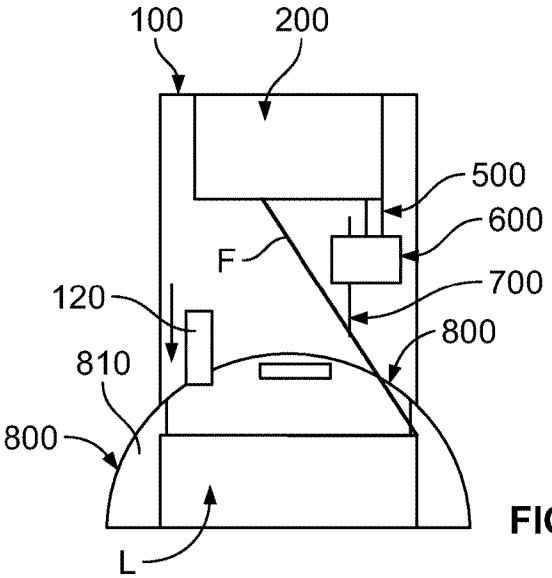
Figure 12E:
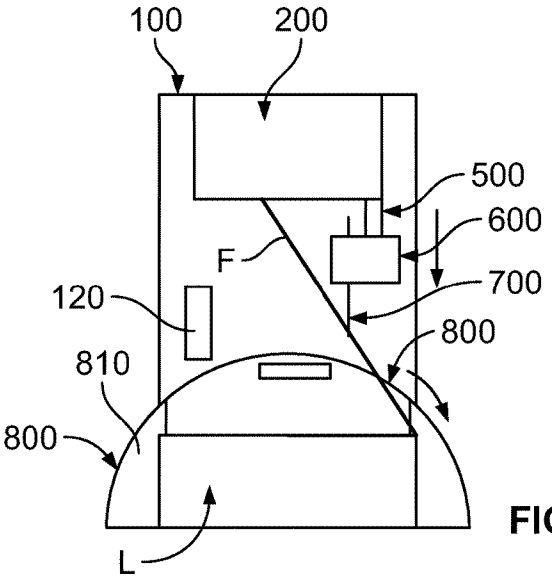

After the turntable 810 has rotated a second amount (and after release of the leading end of the film F), the controller 410 moves the actuating assembly 500 back to its intermediate configuration to cause the film-release assembly 700 to move back to its rest configuration, a block 1012 indicates and as shown in FIG. 12E. Specifically, the controller 410 controls the actuating assembly actuator 502 to move the actuating assembly 500 into its intermediate configuration. Alter the turntable 810 has rotated a third amount to finish wrapping the load L, the controller 410 stops rotating the turntable 810, as block 1014 indicates and as shown in FIG. 12F, by controlling the turntable actuator 800*a* in the appropriate manner. The controller 410 locks the turntable 810, as block 1016 indicates and as shown in FIG. 12F, by controlling the locking-component actuator 130 to move the locking component 120 from the rest position to the locked position.

Figure 12H:
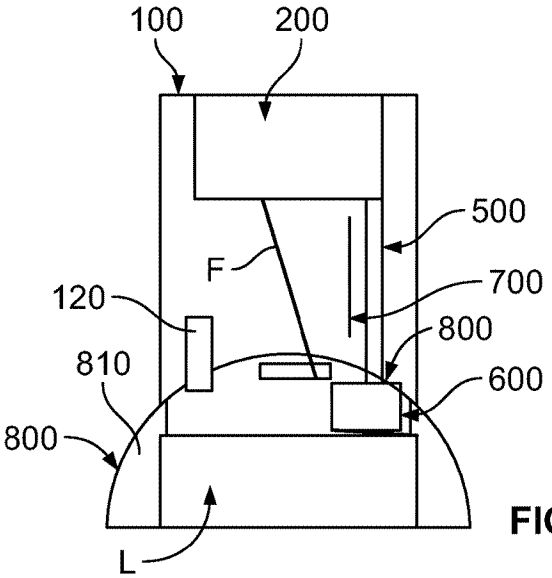
Figure 12G:
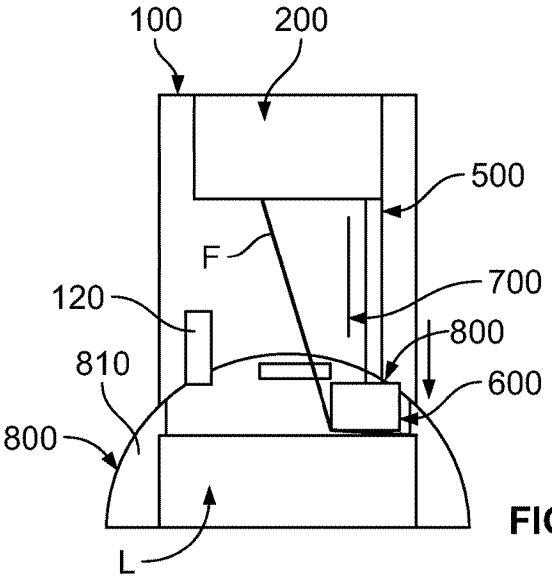

The controller 410 then starts moving the actuating assembly 500 from its intermediate configuration to its seaming configuration to cause the cut-and-seam assembly 600 to begin moving to its seaming configuration, as block 1018 indicates and as shown in FIG. 12G. Specifically, the controller 410 controls the actuating assembly actuator 502 to begin moving the actuating assembly 500 into its seaming configuration. Movement of the actuating assembly 500 to its seaming configuration causes the actuating assembly 500 to contact the film-hold-and-release assembly 900 and cause the film-hold-and-release assembly 900 to grasp a portion of the film extending between the film roll and the load L, as block 1020 indicates and as shown in FIG. 12G.

The cut-and-seam assembly 600 engages the film wrapped around the load L as the actuating assembly 500 reaches its seaming configuration, as block 1022 indicates and as shown in FIG. 12G. The controller 410 controls the cut-and-seam assembly 600 to cut the film F from the roll and seam the trailing end of the film F wrapped around the load L to a portion of the film already wrapped around the load L, as block 1024 indicates and as shown in FIG. 12H The controller 410 controls the actuating assembly 500 to move back to its intermediate configuration, as block 1026 indicates, by controlling the actuating assembly actuator 502 in the appropriate manner. The operator then removes the wrapped load L from the turntable 810, as block 1028 indicates.

Figure 13A:
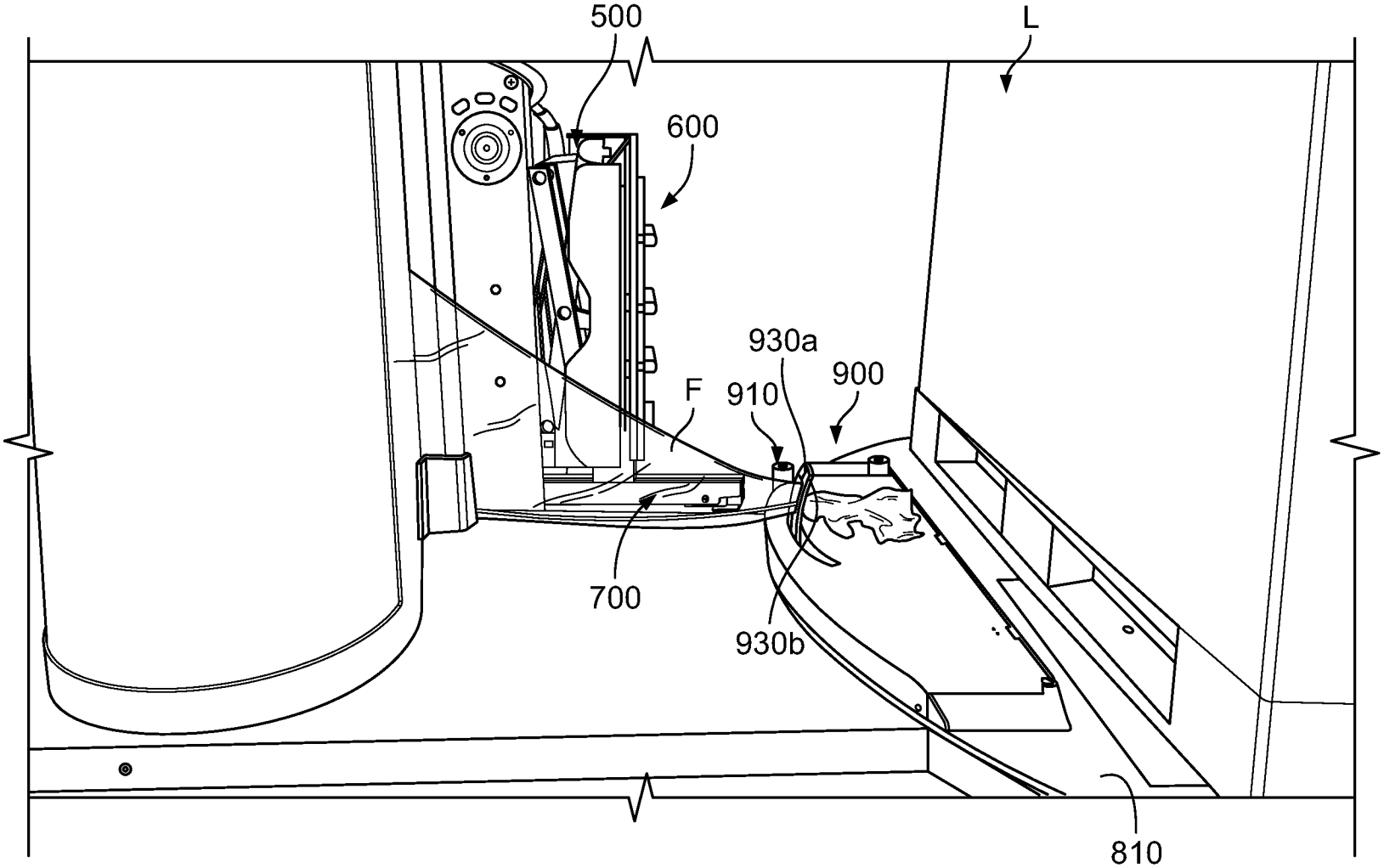
FIGS. 13A-13I are fragmentary perspective views of the wrapping machine of FIG. 1 at different stages of the wrapping process of FIG. 11.

The wrapping process 1000 is now described in more detail with respect to FIGS. 13A-13I. As shown in FIG. 13A, at the beginning of the wrapping process, the locking component 120 of the turntable-locking assembly is in the locking position and received in the locking-component-receiving bore 903*a* of the locking-component receiver 903 of the film-hold-and-release assembly 900. This locks the turntable 810 in place, i.e., prevents the turntable 810 from rotating. Also, the actuating assembly 500 is in the intermediate configuration, meaning that the cut-and-seam assembly 600 is in the intermediate position and the film-release assembly 700 is in the rest configuration. Additionally, the jaws 930*a* and 930*b* are in the closed configuration and hold a leading end of the film F, which is still connected to the roll. The jaw actuator 910 is in the closed position.

Responsive to receiving an appropriate input, the controller 410 controls the locking-component actuator 130 to move the locking component 120 from the locking position to the rest position to unlock the turntable 810. The controller 410 then controls the turntable actuator 800*a* to begin rotating the turntable 810. The controller 410 monitors the amount of rotation (such as the quantity of revolutions) of the turntable 810, such as via feedback from an encoder of the turntable actuator 800*a* or based on one or more sensors.

Figure 13B:
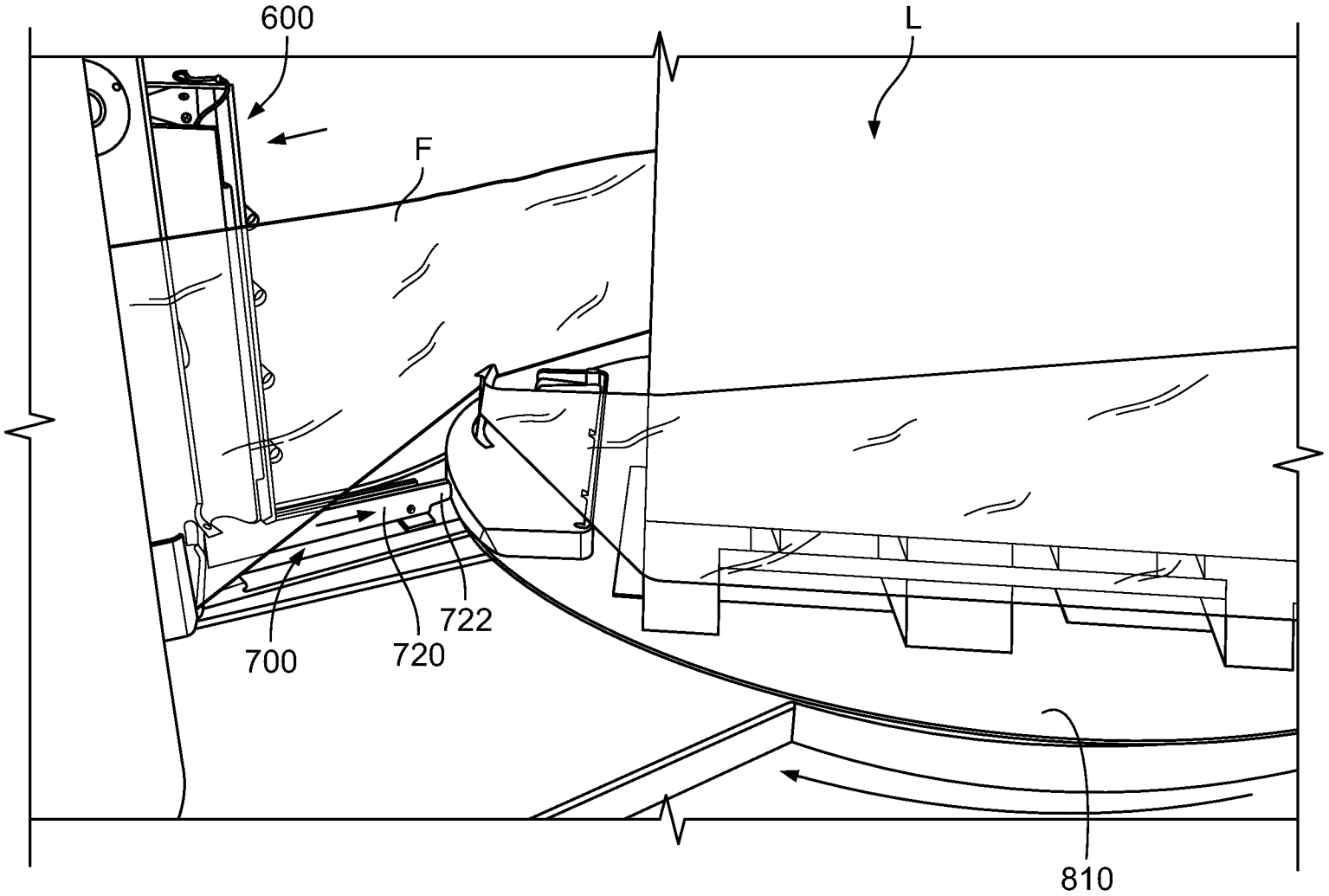

Once the controller 410 determines that the turntable 810 has rotated a first amount (e.g., has completed a first quantity of one or more revolutions), the controller 410 controls the actuating-assembly actuator 502 to move the actuating assembly 500 from the intermediate configuration to the film-release configuration. As this occurs, the film-release-assembly engager 530 engages the lever 740 of the film-release assembly 700. This causes the lever 740 to rotate to the film-release position, which in turn causes the film releaser 720 to move to the film-release position (and thus the film-release assembly 700) to move to the film-release configuration). As shown in FIG. 13B, when the film-release assembly 700 is in the film-release configuration, the first end 722 of the film releaser 720 is adjacent the turntable 810 and in the path of the opening component 914 of the jaw actuator 910.

Figure 13C:
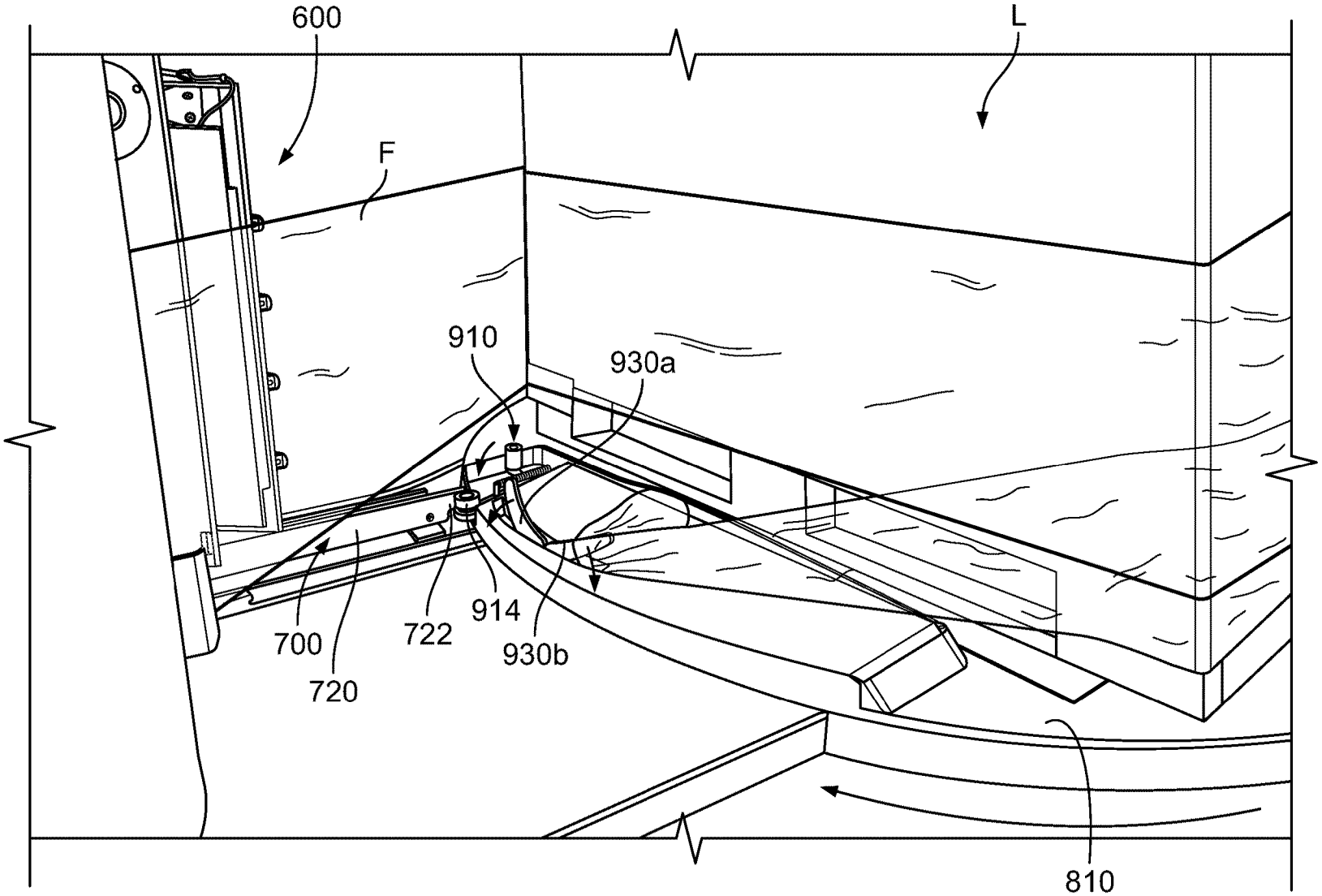

As shown in FIG. 13C, continued rotation of the turntable 810 relative to the film-release assembly 700 causes the opening component 914 to engage the first end 722 of the film releaser 720 and cause the jaw actuator 910 to begin to rotate from the jaw-closed position to the jaw-open position, which causes the jaws 930*a* and 930*b* to begin moving from the closed configuration to the open configuration.

Figure 13D:
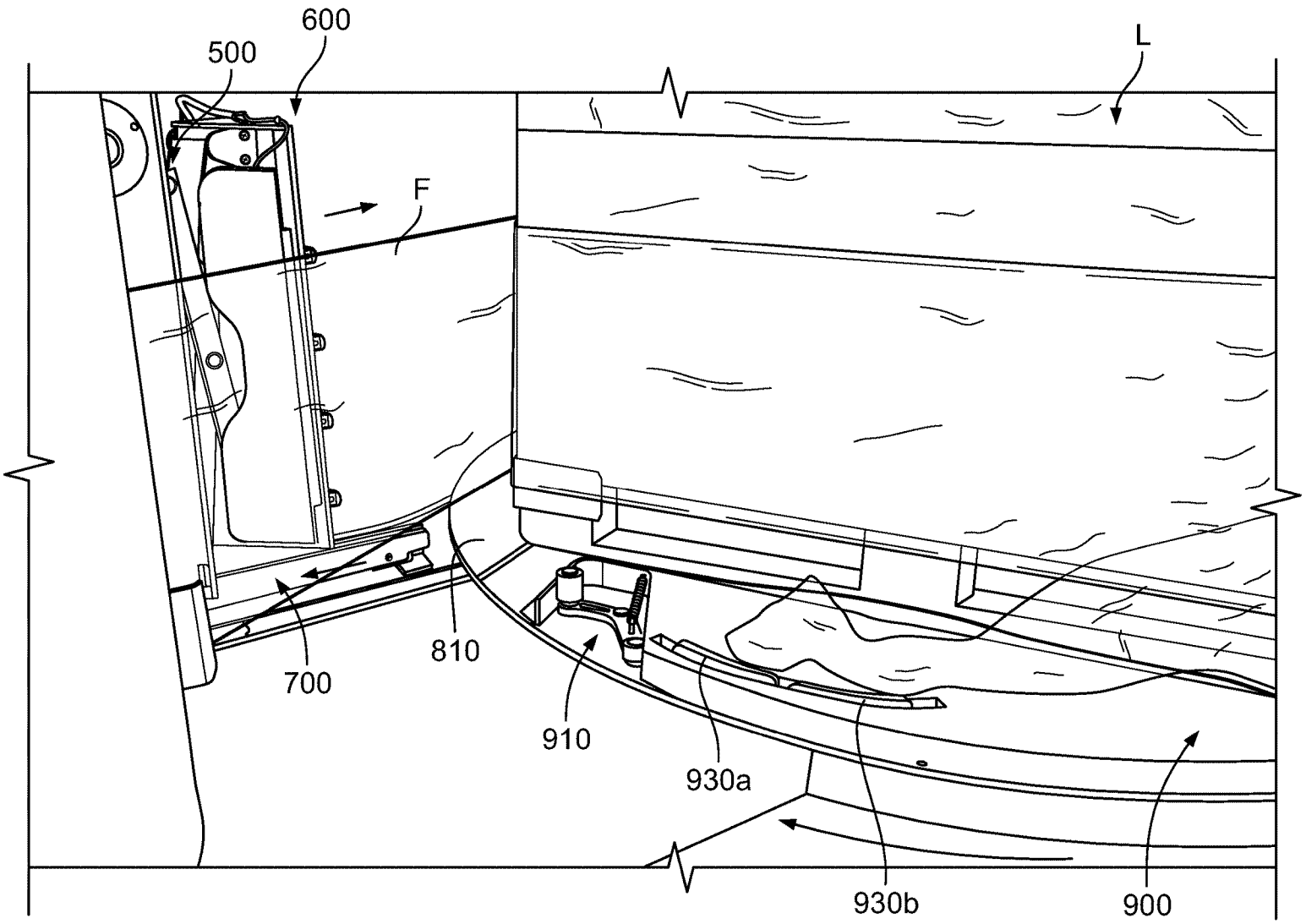

Once the controller 410 determines that the turntable 810 has rotated a second amount (e.g., has completed a second quantity of one or more revolutions), the controller 410 controls the actuating-assembly actuator 502 to move the actuating assembly 500 from the film-release configuration to the intermediate configuration. As this occurs, the film-releaser-biasing element 760 moves the film-release assembly 700 from the film-release configuration to the rest configuration, as shown in FIG. 13D.

Once the controller 410 determines that the turntable 810 has rotated a third amount (e.g., has completed a third quantity of one or more revolutions), the controller 410 controls the turntable actuator 800*a* to stop rotating the turntable 810. The controller 410 controls the locking-component actuator 130 to move the locking component from the rest position to the locking position to lock the turntable 810.

Figure 13E:
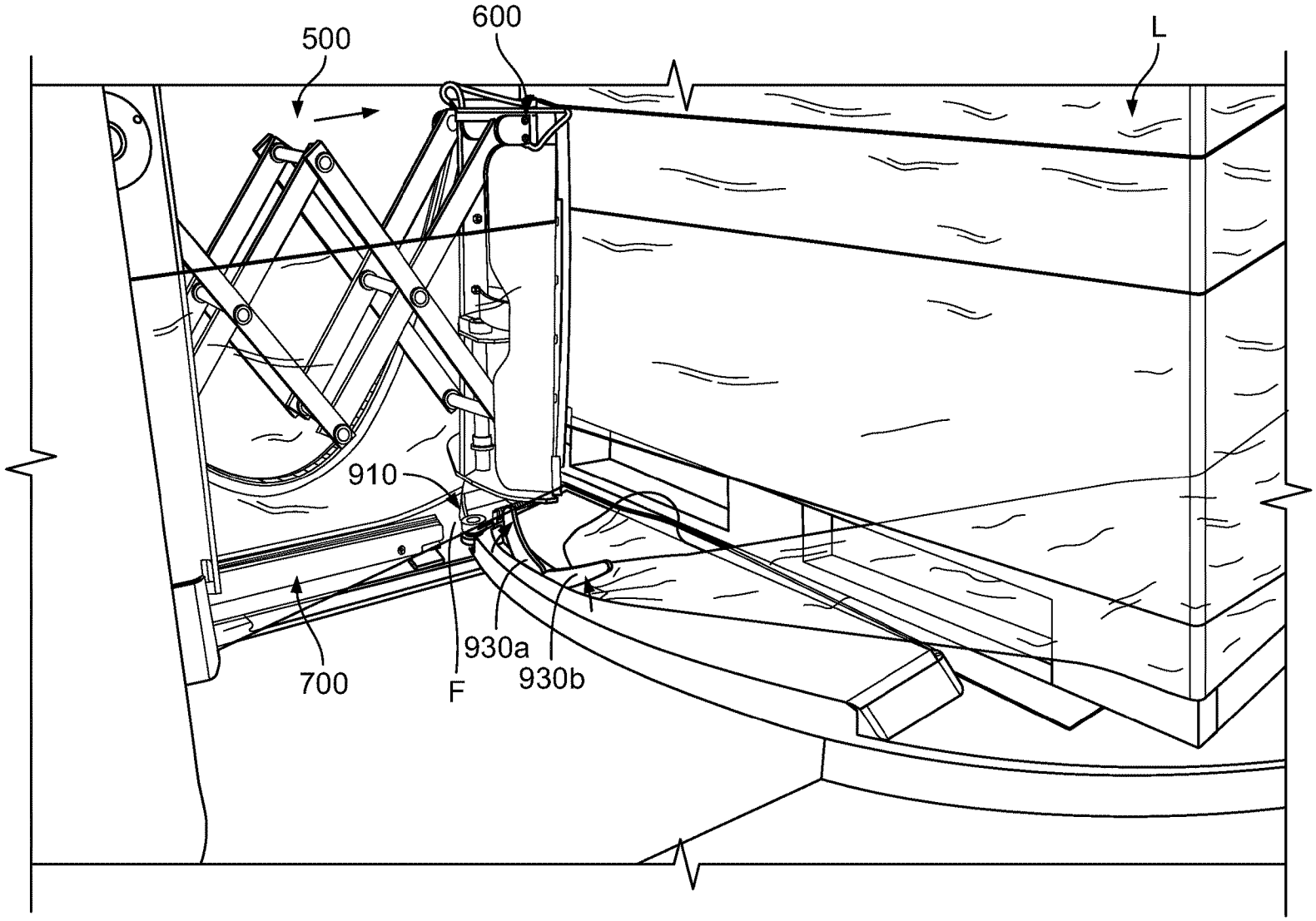

As shown in FIG. 13E, the controller 410 then controls the actuating-assembly actuator 502 to begin moving the actuating assembly 500 from the intermediate configuration to the seaming configuration to begin moving the cut-and-seam assembly 600 toward the load from the intermediate position to the seaming position. As this occurs, the film extending between the load and the roll is stretched across the pads 620*a*-620*e*, the seaming elements 630*a*-630*d*, and the cutting element 640 of the cut-and-seam assembly 600.

Figure 13F:
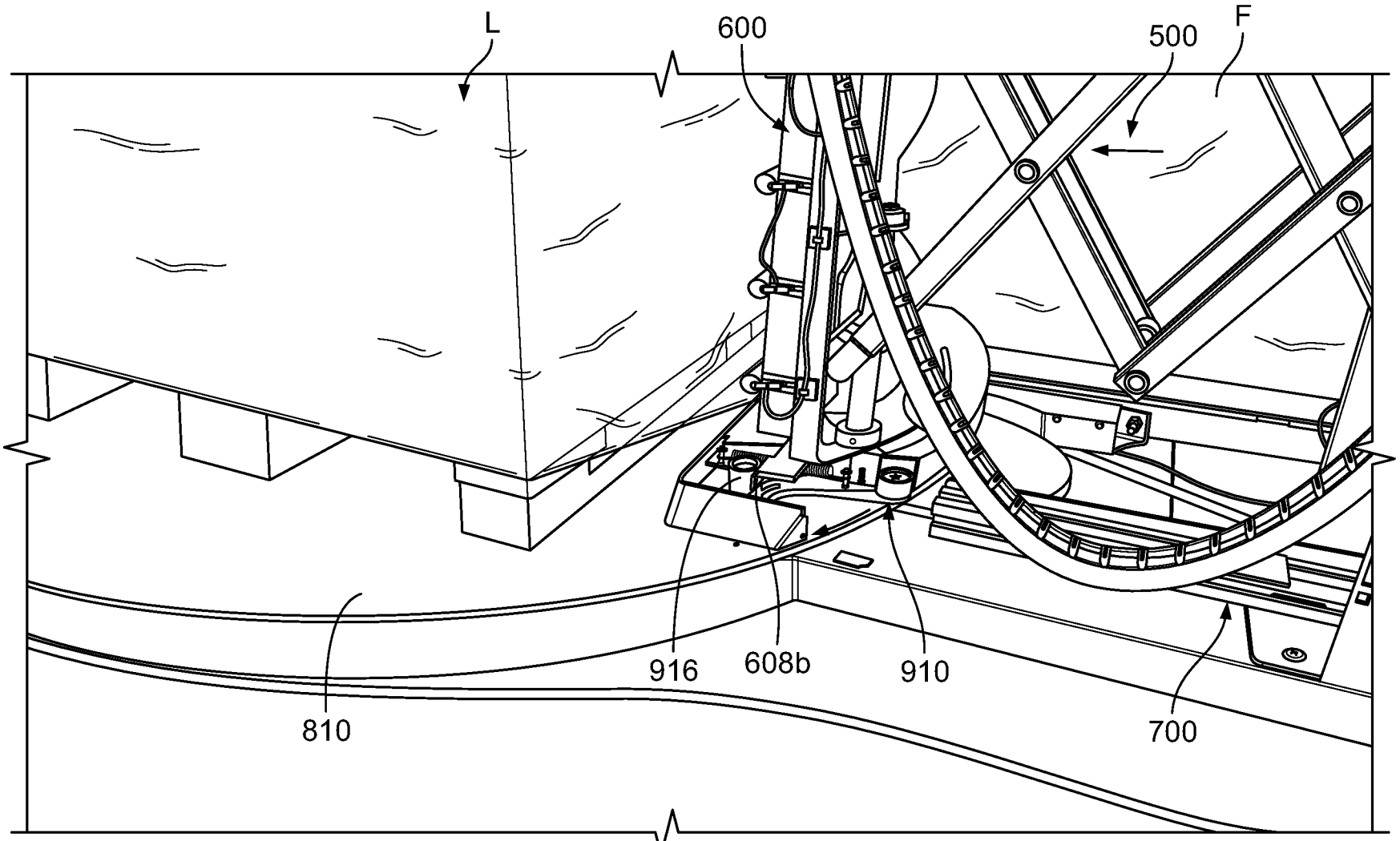
Figure 13G:
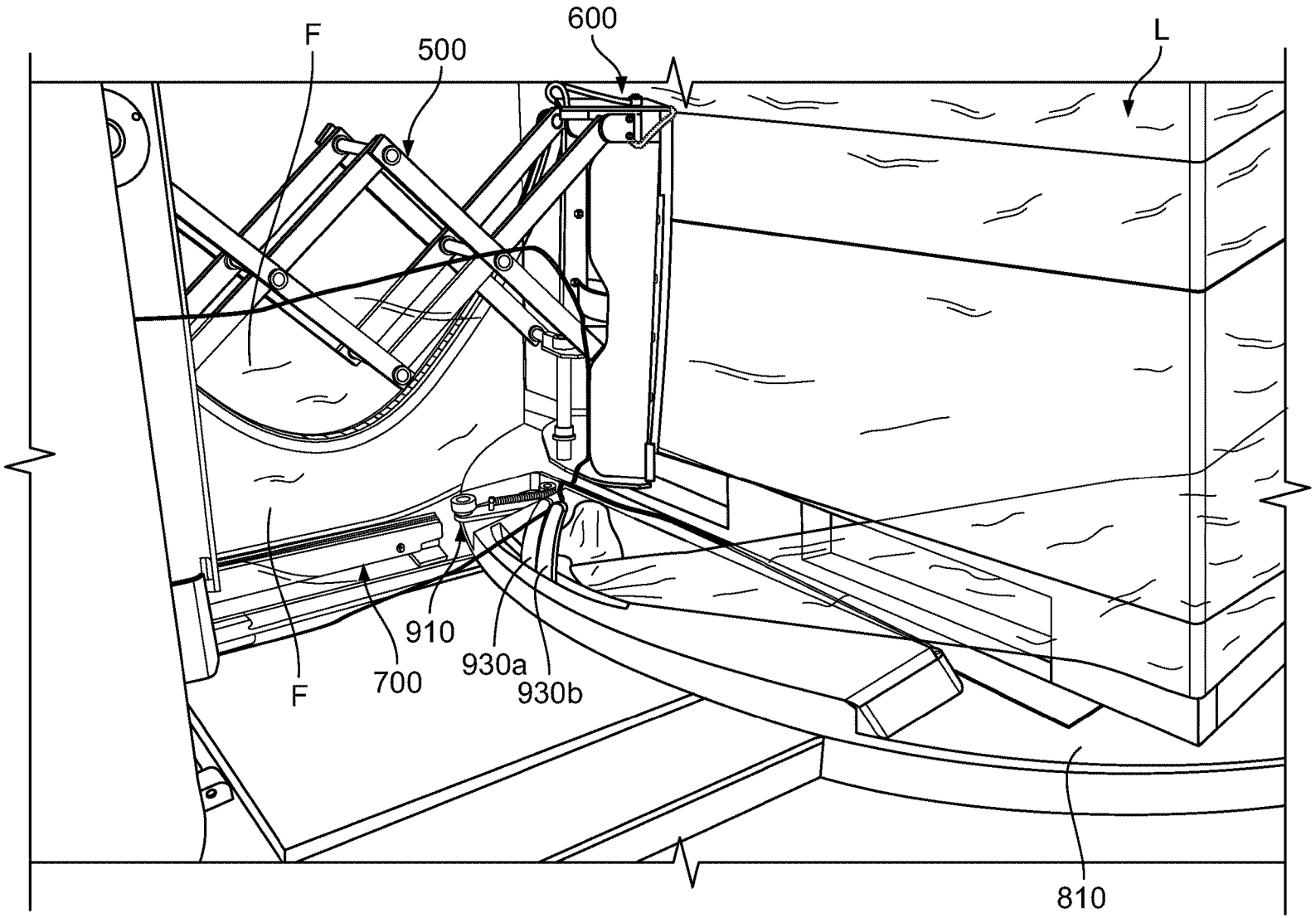
Figure 13H:
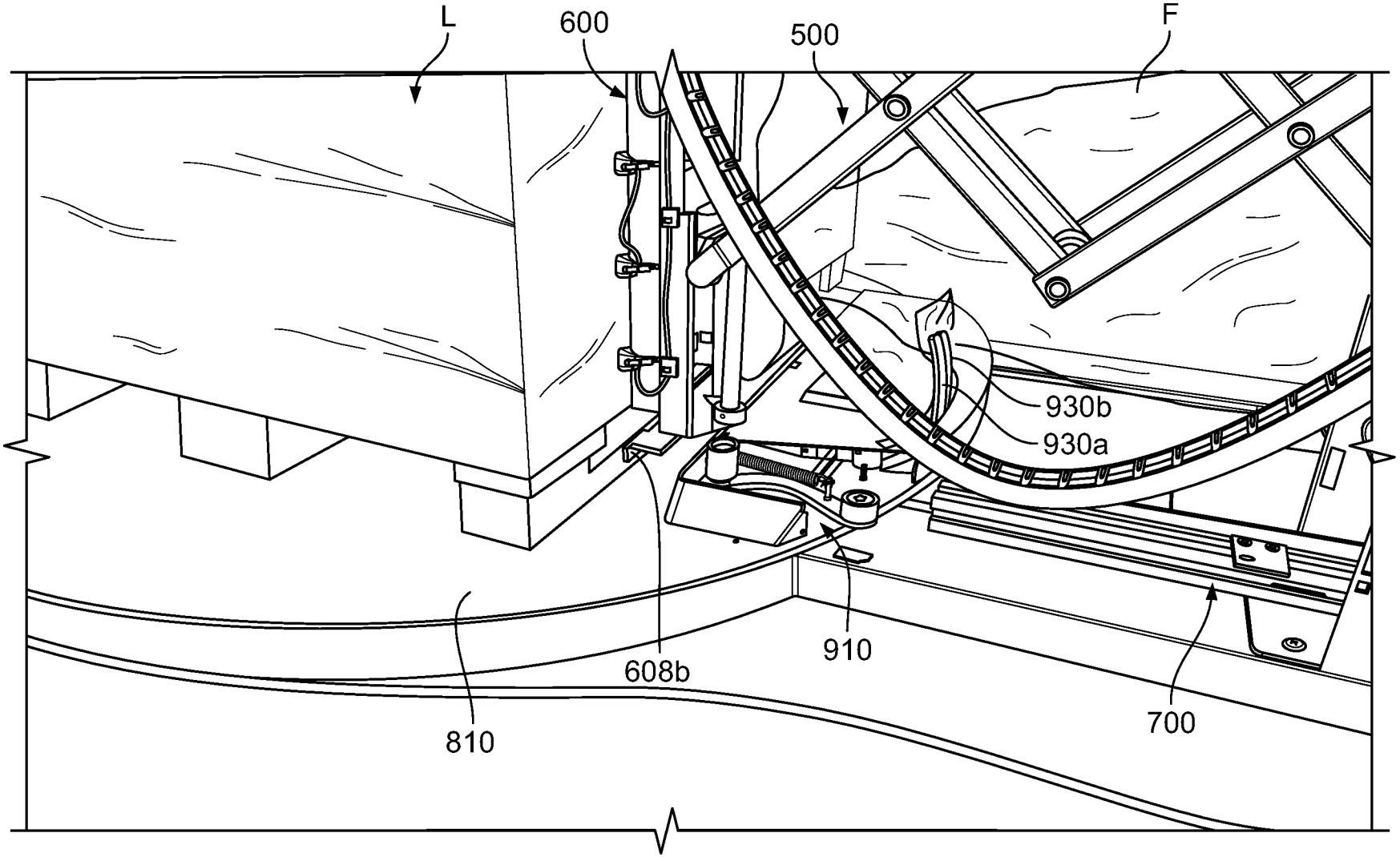

As shown in FIGS. 13F and 13H, as the cut-and-seam assembly 600 approaches the load, the foot 608*b* of the film-hold-and-release assembly engager 608 engages the closing component 916 and causes the jaw actuator 910 to rotate from the jaw-open position to the jaw-closed position, which causes the jaws 930*a* and 930*b* to move from the open configuration to the closed configuration to clamp part of the film therebetween, as shown in FIG. 13G.

Eventually, one or more of the seaming elements 630*a*-630*d* engage the load. Continued movement of the cut-and-seam assembly 600 causes one or more of the seaming elements 630*a*-630*d* to begin moving from the rest configuration to the actuating configuration. As explained above, movement of any one of the seaming elements 630*a*-630*d* from the rest configuration to the actuating configuration causes the plate 634 of that seaming element to break the beam transmitted by the photocell 682. The photocell 682 transmits a corresponding signal to the controller 410.

Figure 13I:
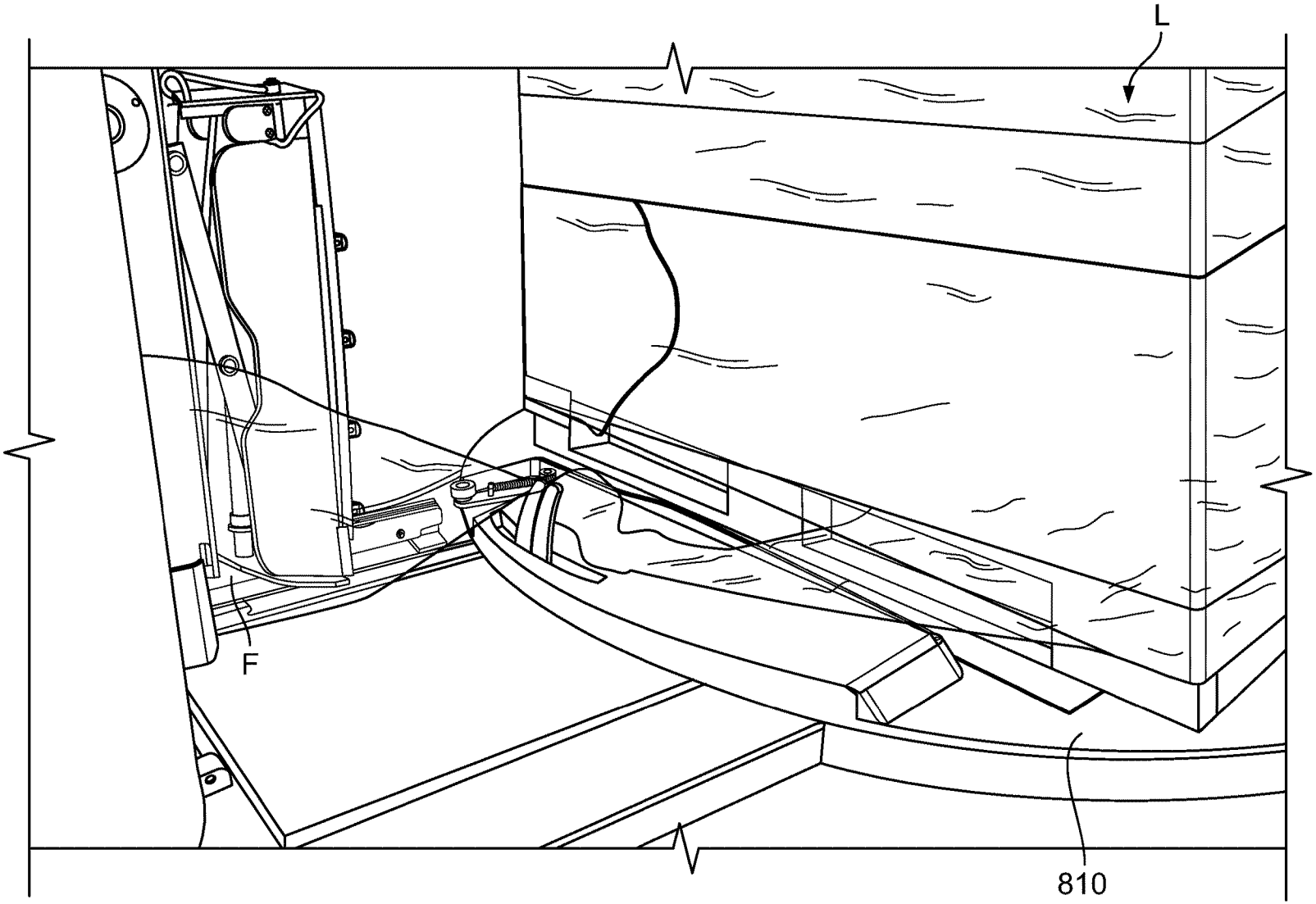

In response, the controller 410 stops the actuating-assembly actuator 502 and causes electricity to flow to the resistive healing elements of the seaming bars 632*a*-632*d* of the seaming elements 630*a*-630*d* and to the resistive heating element of the cutting device 640. This causes: (1) the anting device 640 to cut the film (via local melting) to form a leading end of the film on the roll held by the jaws 930*a* and 930*b* and a trailing end of the film wrapped around the load; and (2) the framing elements 630*a*-630*d* to locally heat-weld the trailing end of the film to part of the film already wrapped around the load. After a designated period of time has elapsed, the controller 410 controls the actuating assembly 500 to return to the intermediate configuration, as shown in FIG. 13I. At this point, the now-wrapped load may be removed from the turntable assembly 800.

The wrapping machine of the present disclosure improves upon prior art wrapping machines because it does not require the turntable itself to include any of electric, hydraulic, pneumatic, or any other type of power supply to operate the cut, clamp, and seam assembly to cut, hold, and seam the film. Rather, the cut, clamp, and seam assembly relies on an actuator supported by the base along with several mechanical components that move and interact with one another to carry out this functionality. This results in a wrapping machine that is simpler and easier to maintain than prior art wrapping machines.

In various embodiments, a wrapping machine of the present disclosure comprises a base; a turntable rotatable relative to the base; and a cut, clamp, and seam system. The cut, clamp, and seam system comprises a cut-and-seam assembly movable among a film-release position, an intermediate position, and a seaming position; an actuating assembly supported by the base and to which the cut-and-seam assembly is mounted, the actuating assembly movable among a film-release configuration, an intermediate configuration, and a seaming configuration; and a film-release assembly supported by the base, the film-release assembly movable between a rest configuration and a film-release configuration. When the actuating assembly is in the film-release configuration, the cut-and-seam assembly is in the film-release position and the film-release assembly is in the film-release configuration. When the actuating assembly is in the intermediate configuration, the cut-and-seam assembly is in the intermediate position and the film-release assembly is in the rest configuration. When the actuating assembly is m the seaming configuration, the cut-and-seam assembly is in the seaming position and the film-release assembly is in the rest configuration.

In certain such embodiments, the film-release assembly comprises a film releaser having a first end. The first end of the film releaser is a first distance from the turntable when the film-release assembly is in the rest configuration and a second distance from the turntable when the film-release assembly is in the film-release configuration. The second distance is smaller than the first distance.

In certain such embodiments, the film-release assembly further comprises a film-releaser-biasing element biasing the film-release assembly to the rest configuration.

In certain such embodiments, the film-release assembly further comprises a lever rotatable between a first position and a second position. The lever is operable connected to the film releaser to move the film releaser between a rest position and a film-release position. The actuating assembly comprises a film-release-assembly engager positioned such that movement of the actuating assembly from the intermediate configuration to the film-release configuration causes the film-release-assembly engager to engage the lever and move the lever from the first position to the second position to cause the lever to move the film releaser from the rest position to the film-release position.

In certain such embodiments, the cut-and-seam assembly comprises a mounting plate, a sensor, and a seaming element mounted to the mounting plate and movable relative to the mounting plate between a rest configuration and an actuating configuration. The sensor is configured to sense when mounting plate has moved from the rest configuration to the actuating configuration.

In certain such embodiments, the actuating assembly comprises an actuating assembly actuator configured to move the actuating assembly among the film-release configuration, the intermediate configuration, and the seaming configuration.

In certain such embodiments, the wrapping machine further comprising a controller communicatively connected to the sensor and operably connected to the actuating assembly actuator to control the actuating assembly actuator. The controller is configured to, while controlling the actuator to move the actuating assembly from the intermediate configuration to the seaming configuration, determine that the actuating assembly has reached the seaming configuration and control the actuating assembly actuator to stop moving the actuating assembly responsive to receipt, from the sensor, of a signal indicating that the sensor has sensed that the mounting plate has moved from the rest configuration to the actuating configuration.

In certain such embodiments, the wrapping machine further comprises a turntable actuator operably connected to the turntable to rotate the turntable relative to the base and a turntable sensor configured to detect a complete revolution of the turntable.

In certain such embodiments, the actuating assembly comprises an actuating assembly actuator configured to move the actuating assembly among the film-release configuration, the intermediate configuration, and the seaming configuration. The wrapping machine further comprises a controller communicatively connected to the turntable sensor, operably connected to the turntable actuator to control the turntable actuator, and operably connected to the actuating assembly actuator to control the actuating assembly actuator. The controller is configured to, following initiation of a wrapping process: control the turntable actuator to begin rotating the turntable; determine an amount of rotation of the turntable based on signals received from the turntable sensor; and responsive to the turntable rotating a first amount, control the actuating assembly actuator to move the actuating assembly from the intermediate configuration to the film-release configuration, thereby causing the film-release assembly to move from the rest configuration to the film-release configuration.

In certain such embodiments, the controller is further configured to, responsive to the turntable rotating a second amount greater than the first amount, control the actuating assembly actuator to move the actuating assembly from the film-release configuration to the intermediate configuration, thereby enabling the film-release assembly to move from the film-release configuration to the rest configuration.

In certain such embodiments, the controller is further configured to, responsive to the turntable rotating a third amount greater than the second amount, control the actuating assembly actuator to move the actuating assembly from the intermediate configuration to the seaming configuration.

In certain such embodiments, the wrapping machine further comprises a film hold-and-release assembly supported by the turntable, the film hold-and-release assembly comprising a pair of jaws and a jaw actuator operably connected to the jaws to move the jaws between a closed configuration and an open configuration.

In certain such embodiments, the jaw actuator is movable between a jaw-open position and a jaw-closed position, wherein the jaws are in the open configuration when the jaw actuator is in the jaw-open position and the jaws are in the closed configuration when the jaw actuator is in the jaw-closed position.

In certain such embodiments, the jaw actuator comprises an opening component and a closing component. When the jaw actuator is in the jaw-closed position, the opening component extends from a perimeter of the turntable such that, when the film-release assembly is in the film-release configuration, rotation of the turntable causes part of the film-release assembly to contact the opening component and cause the jaw actuator to move to the jaw-open position to move the jaws to the open configuration.

In certain such embodiments, when the jaw actuator is in the jaw-open position, the closing component is positioned such that, when the turntable is stationary, movement of the actuating assembly from the intermediate configuration to the seaming configuration causes the cut-and-seam assembly to contact the closing component and cause the jaw actuator to move to the jaw-closed position to move the jaws to the closed configuration.

In various embodiments, a method of operating a wrapping machine comprises: with a film-hold-and-release assembly holding a leading end of a roll of film, rotating a turntable on which the film-hold-and-release assembly is mounted relative to an actuating assembly; moving the actuating assembly to a film-release configuration, thereby causing a film-release assembly to move to a film-release configuration; and continue rotating the turntable such that the film-hold-and-release assembly contacts the film-release assembly, thereby causing the film-hold-and-release assembly to release the leading end of the film.

In certain such embodiments, the method further comprises: stop rotating the turntable; and begin moving the actuating assembly to a seaming configuration, thereby causing a cut-and-seam assembly mounted to the actuating assembly to contact the film hold-and-release assembly, thereby causing the film-hold-and-release assembly to grasp the film.

In certain such embodiments, the method further comprises, after the actuating assembly reaches the seaming configuration such that the cut-and-seam assembly contacts a portion of the film wrapped around the load, cutting the film from the roll via the cut-and-seam assembly to form a trailing end of the film wrapped around the load and attaching the trailing end to the portion of the film already wrapped around the load via the cut-and-seam assembly.

In certain such embodiments, the method further comprises determining, via a controller, that the actuating assembly reaches the seaming configuration responsive to feedback from a sensor mounted to the cut-and-seam assembly.

In certain such embodiments, the method further comprises: moving the actuating assembly to the film-release configuration after the turntable has rotated a first amount; moving the actuating assembly to the intermediate configuration after the turntable has rotated a second amount; and moving the actuating assembly to the seaming configuration after the turntable has rotated a third amount.

The invention claimed is:

1. A wrapping machine comprising:

a base;

a turntable rotatable relative to the base; and a cut, clamp, and seam system comprising:

a cut-and-seam assembly movable among a film-release position, an intermediate position, and a seaming position;

an actuating assembly supported by the base and to which the cut-and-seam assembly is mounted, the actuating assembly movable among a film-release configuration, an intermediate configuration, and a seaming configuration; and a film-release assembly supported by the base, the film-release assembly movable between a rest configuration and a film-release configuration, wherein when the actuating assembly is in the film-release configuration, the cut-and-seam assembly is in the film-release position and the film-release assembly is in the film-release configuration, wherein when the actuating assembly is in the intermediate configuration, the cut-and-seam assembly is in the intermediate position and the film-release assembly is in the rest configuration, wherein when the actuating assembly is in the seaming configuration, the cut-and-seam assembly is in the seaming position and the film-release assembly is in the rest configuration, and wherein the actuating assembly is operably connected to the cut-and-seam assembly and the film-release assembly to cause the cut-and-seam assembly to move among the film-release configuration, the intermediate configuration, and the seaming configuration and the film-release assembly to move between the rest configuration and the film-release configuration.

2. The wrapping machine of claim 1, wherein the film-release assembly comprises a film releaser having a first end, wherein the first end of the film releaser is a first distance from the turntable when the film-release assembly is in the rest configuration and a second distance from the turntable when the film-release assembly is in the film-release configuration, wherein the second distance is smaller than the first distance.

3. The wrapping machine of claim 2, wherein the film-release assembly further comprises a film-releaser-biasing element biasing the film-release assembly to the rest configuration.

4. The wrapping machine of claim 2, wherein the film-release assembly further comprises a lever rotatable between a first position and a second position, wherein the lever is operably connected to the film releaser to move the film releaser between a rest position and a film-release position, wherein the actuating assembly comprises a film-release-assembly engager positioned such that movement of the actuating assembly from the intermediate configuration to the film-release configuration causes the film-release-assembly engager to engage the lever and move the lever from the first position to the second position to cause the lever to move the film releaser from the rest position to the film-release position.

5. The wrapping machine of claim 1, wherein the cut-and-seam assembly comprises a mounting plate, a sensor, and a seaming element mounted to the mounting plate and movable relative to the mounting plate between a rest configuration and an actuating configuration, wherein the sensor is configured to sense that the mounting plate has moved from the rest configuration to the actuating configuration.

6. The wrapping machine of claim 5, wherein the actuating assembly comprises an actuating assembly actuator configured to move the actuating assembly among the film-release configuration, the intermediate configuration, and the seaming configuration.

7. The wrapping machine of claim 6, further comprising a controller communicatively connected to the sensor and operably connected to the actuating assembly actuator to control the actuating assembly actuator, wherein the controller is configured to, while controlling the actuator to move the actuating assembly from the intermediate configuration to the seaming configuration, determine that the actuating assembly has reached the seaming configuration and control the actuating assembly actuator to stop moving the actuating assembly responsive to receipt, from the sensor, of a signal indicating that the sensor has sensed that the mounting plate has moved from the rest configuration to the actuating configuration.

8. The wrapping machine of claim 1, further comprising a turntable actuator operably connected to the turntable to rotate the turntable relative to the base and a turntable sensor configured to detect a complete revolution of the turntable.

9. The wrapping machine of claim 8, wherein the actuating assembly comprises an actuating assembly actuator configured to move the actuating assembly among the film-release configuration, the intermediate configuration, and the seaming configuration, the wrapping machine further comprising a controller communicatively connected to the turntable sensor, operably connected to the turntable actuator to control the turntable actuator, and operably connected to the actuating assembly actuator to control the actuating assembly actuator, the controller configured to, following initiation of a wrapping process:

control the turntable actuator to begin rotating the turntable;

determine an amount of rotation of the turntable based on signals received from the turntable sensor; and responsive to the turntable rotating a first amount, control the actuating assembly actuator to move the actuating assembly from the intermediate configuration to the film-release configuration, thereby causing the film-release assembly to move from the rest configuration to the film-release configuration.

10. The wrapping machine of claim 9, wherein the controller is further configured to, responsive to the turntable rotating a second amount greater than the first amount, control the actuating assembly actuator to move the actuating assembly from the film-release configuration to the intermediate configuration, thereby enabling the film-release assembly to move from the film-release configuration to the rest configuration.

11. The wrapping machine of claim 10, wherein the controller is further configured to, responsive to the turntable rotating a third amount greater than the second amount, control the actuating assembly actuator to move the actuating assembly from the intermediate configuration to the seaming configuration.

12. The wrapping machine of claim 1, further comprising a film hold-and-release assembly supported by the turntable, the film hold-and-release assembly comprising a pair of jaws and a jaw actuator operably connected to the jaws to move the jaws between a closed configuration and an open configuration.

13. The wrapping machine of claim 12, wherein the jaw actuator is movable between a jaw-open position and a jaw-closed position, wherein the jaws are in the open configuration when the jaw actuator is in the jaw-open position and the jaws are in the closed configuration when the jaw actuator is in the jaw-closed position.

14. The wrapping machine of claim 13, wherein the jaw actuator comprises an opening component and a closing component, wherein when the jaw actuator is in the jaw-closed position, the opening component extends from a perimeter of the turntable such that, when the film-release assembly is in the film-release configuration, rotation of the turntable causes part of the film-release assembly to contact the opening component and cause the jaw actuator to move to the jaw-open position to move the jaws to the open configuration.

15. The wrapping machine of claim 14, wherein when the jaw actuator is in the jaw-open position, the closing component is positioned such that, when the turntable is stationary, movement of the actuating assembly from the intermediate configuration to the seaming configuration causes the cut-and-seam assembly to contact the closing component and cause the jaw actuator to move to the jaw-closed position to move the jaws to the closed configuration.

16. A method of operating a wrapping machine, the method comprising:

with a film-hold-and-release assembly holding a leading end of a roll of film, rotating a turntable on which the film-hold-and-release assembly is mounted relative to an actuating assembly;

moving the actuating assembly to a film-release configuration, thereby causing a_film-release assembly and a cut-and-seam assembly to move to a film-release configuration; and continue rotating the turntable such that the film-hold-and-release assembly contacts the film-release assembly, thereby causing the film-hold-and-release assembly to release the leading end of the film.

17. The method of claim 16, further comprising:

stop rotating the turntable; and begin moving the actuating assembly to a seaming configuration, thereby causing all the cut-and-seam assembly mounted to the actuating assembly to contact the film hold-and-release assembly, thereby causing the film-hold-and-release assembly to grasp the film.

18. The method of claim 17, further comprising, after the actuating assembly reaches the seaming configuration such that the cut-and-seam assembly contacts a portion of the film wrapped around the load, cutting the film from the roll via the cut-and-seam assembly to form a trailing end of the film wrapped around the load and attaching the trailing end to the portion of the film already wrapped around the load via the cut-and-seam assembly.

19. The method of claim 18, further comprising determining, via a controller, that the actuating assembly reaches the seaming configuration responsive to feedback from a sensor mounted to the cut-and-seam assembly.

20. The method of claim 19, further comprising:

moving the actuating assembly to the film-release configuration after the turntable has rotated a first amount;

moving the actuating assembly to the intermediate configuration after the turntable has rotated a second amount; and moving the actuating assembly to the seaming configuration after the turntable has rotated a third amount.

* * * * *